US010066366B2

(12) United States Patent
Yukawa

(10) Patent No.: US 10,066,366 B2
(45) Date of Patent: Sep. 4, 2018

(54) WORK MACHINE, SUPPORT MECHANISM FOR OPERATION DEVICE, AND SHOCK-ABSORBING MECHANISM FOR OPERATION DEVICE

(71) Applicant: KUBOTA CORPORATION, Osaka-shi (JP)

(72) Inventor: Katsuhiko Yukawa, Sakai (JP)

(73) Assignee: KUBOTA CORPORATION, Osaka-Shi (JP)

( * ) Notice: Subject to any disclaimer, the term of this patent is extended or adjusted under 35 U.S.C. 154(b) by 47 days.

(21) Appl. No.: 15/099,800

(22) Filed: Apr. 15, 2016

(65) Prior Publication Data

US 2016/0305092 A1 Oct. 20, 2016

(30) Foreign Application Priority Data

Apr. 17, 2015 (JP) ..... 2015-085120
Apr. 17, 2015 (JP) ..... 2015-085121
Apr. 17, 2015 (JP) ..... 2015-085122

(51) Int. Cl.

*E02F 9/20* (2006.01)
*E02F 3/32* (2006.01)
*E02F 9/16* (2006.01)
*E02F 9/08* (2006.01)

(52) U.S. Cl.

CPC ..... *E02F 9/2004* (2013.01); *E02F 3/325* (2013.01); *E02F 9/0833* (2013.01); *E02F 9/166* (2013.01)

(58) Field of Classification Search

CPC ..... E02F 9/2004; E02F 3/325; E02F 9/0833; E02F 9/166

See application file for complete search history.

(56) References Cited

U.S. PATENT DOCUMENTS 5,800,012 A * 9/1998 Ziegler ..... B60N 2/286 297/181
5,860,488 A * 1/1999 Kim ..... B60N 2/4626 180/271
7,159,684 B2 * 1/2007 Dahl ..... B60K 28/04 180/271
7,165,472 B2 * 1/2007 Jo ..... E02F 9/2004 180/271
2009/0321171 A1 * 12/2009 Hakansson ..... B62D 1/18 180/333

FOREIGN PATENT DOCUMENTS

JP 07-016639 U 3/1995
JP 07-331703 12/1995
JP 08027839 A * 1/1996 ..... E02F 9/2004
JP 09-025643 1/1997
JP 10-280481 1/1998
JP 11-006171 1/1999
JP 2009-001263 1/2009
JP 2009-235799 10/2009
JP 2010265582 A * 11/2010 ..... B60N 2/10
JP 2011-019804 2/2011

* cited by examiner

*Primary Examiner* — Faye M Fleming
(74) *Attorney, Agent, or Firm* — Mori & Ward, LLP

(57) ABSTRACT

A work machine includes: an operator seat; an operation device having an operation lever; a working device to be operated via the operation lever; and a support mechanism to support the operation device selectively at a first position or a second position, the first position being on a side of the operator seat, the second position being located forward with respect to the operator seat.

17 Claims, 26 Drawing Sheets

WORK MACHINE, SUPPORT MECHANISM FOR OPERATION DEVICE, AND SHOCK-ABSORBING MECHANISM FOR OPERATION DEVICE

CROSS-REFERENCE TO RELATED APPLICATIONS

The present application claims priority under 35 U.S.C. § 119 to Japanese Patent Application No. 2015-085120, filed Apr. 17, 2015, to Japanese Patent Application No. 2015-085121, filed Apr. 17, 2015, and to Japanese Patent Application No. 2015-085122, filed Apr. 17, 2015. The contents of these applications are incorporated herein by reference in their entirety.

BACKGROUND OF THE INVENTION

Field of the Invention

The present invention relates to a work machine, to a support mechanism for an operation device, and to a shock-absorbing mechanism for the operation device.

Discussion of the Background

Japanese Unexamined Patent Application Publication No. 2009-235799, for example, discloses a backhoe arranging an operation device on a side of an operator seat, the operation device having an operation lever for a working device. The backhoe is previously known widely. Meanwhile, an operator requests to watch a point excavated in front of the backhoe in an excavating operation, a spared space is limited on both sides of the operator seat, and thus a compact backhoe generally arranges the operation device in front of the operator seat. Japanese Unexamined Patent Application Publication No. H11-6171, for example, discloses the compact backhoe.

The contents of Japanese Unexamined Patent Application Publication No. 2009-235799 and Japanese Unexamined Patent Application Publication No. H11-6171 are incorporated herein by reference in their entirety.

SUMMARY OF THE INVENTION

A work machine according to one aspect of the present invention includes: an operator seat; an operation device having an operation lever; a working device to be operated via the operation lever; and a support mechanism to support the operation device selectively at a first position or a second position, the first position being on a side of the operator seat, the second position being located forward with respect to the operator seat.

In addition, a work machine according to another aspect of the present invention includes: an operator seat; an operation device to be turned around a fulcrum between a first position being on a side of the operator seat and a second position being located with respect to the first position, the fulcrum being positioned above a center of gravity of the operation device when the operation device is located on the first position, the operation device having an operation lever; and a working device—to be operated via the operation lever.

Moreover, a work machine according to still another aspect of the present invention includes: an operator seat; an operation device having an operation lever; a working device configured to be operated via the operation lever; and a support mechanism to support the operation device to be turned between a first position being on a side of the operator seat and a second position being located upward with respect to the operator seat; and a shock-absorbing mechanism to absorb a shock generated when the operation device is turned from the second position to the first position.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

FIG, 25 is a side view showing the work machine according to the embodiment.

DESCRIPTION OF THE EMBODIMENTS

Figure 1:
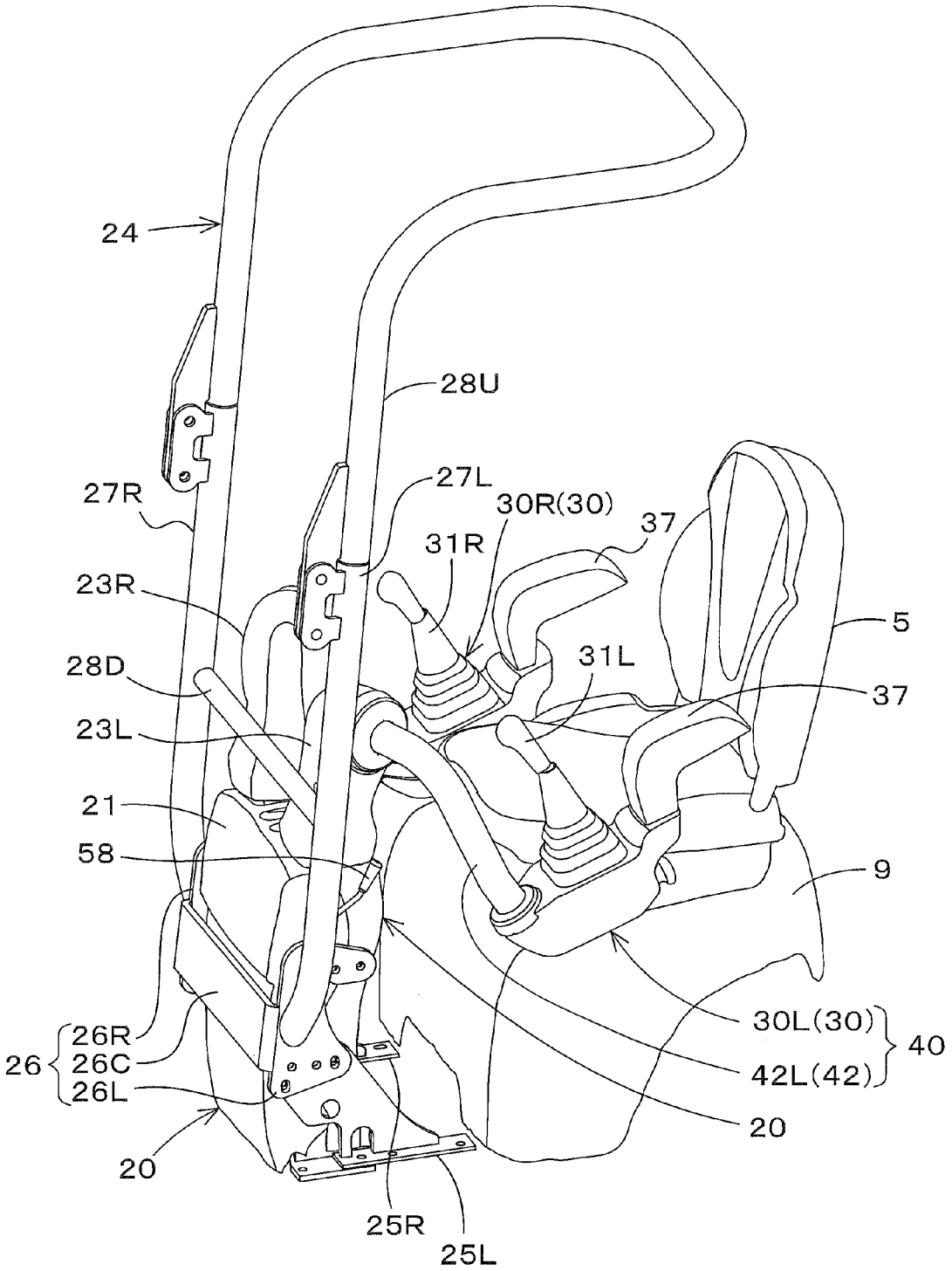
FIG. 1 is a perspective view showing an operator seat and a periphery of the operator seat of a work machine according to an embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Figure 24:
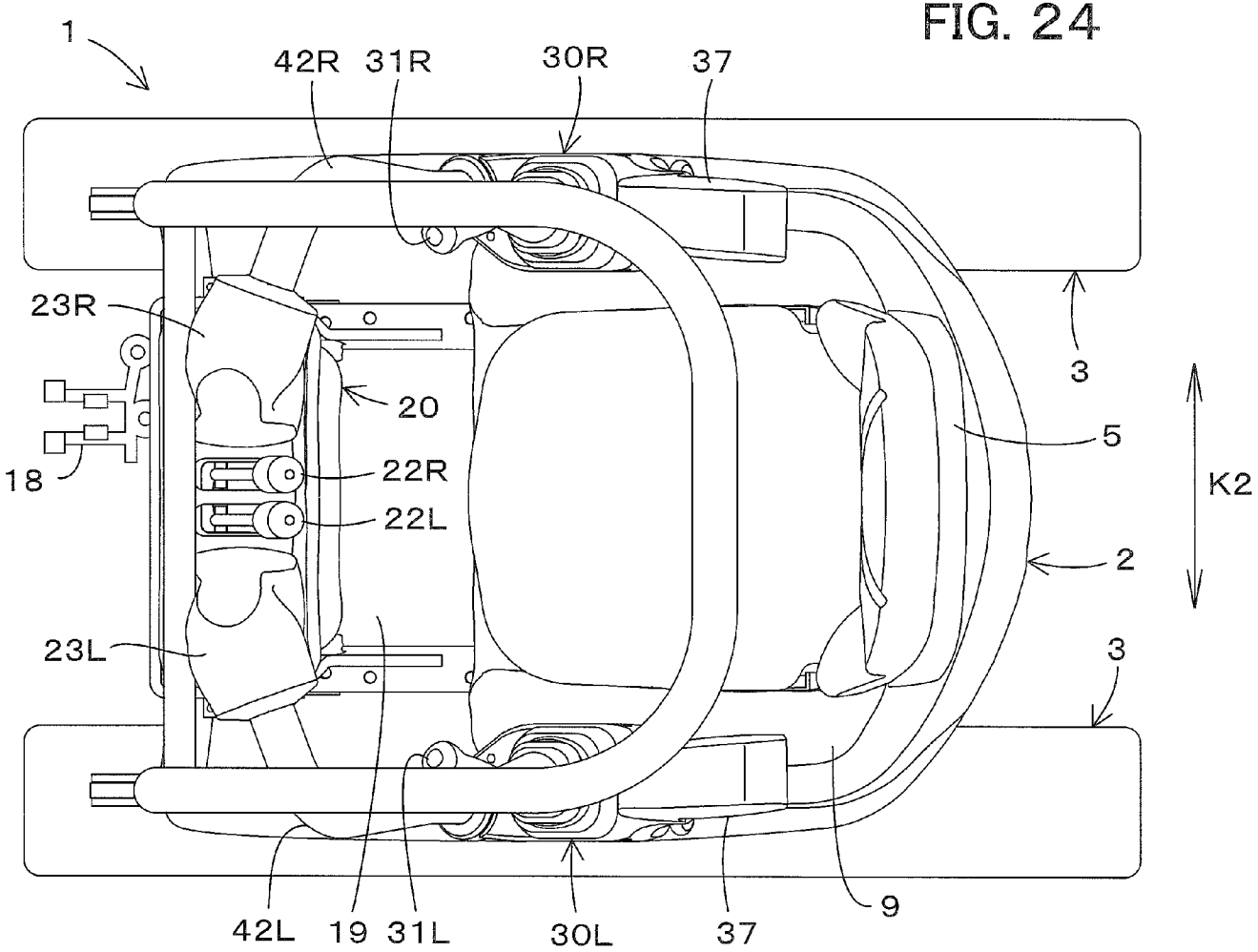
FIG. 24 is a plan view showing the work machine according to the embodiment without a working device.
Figure 25:
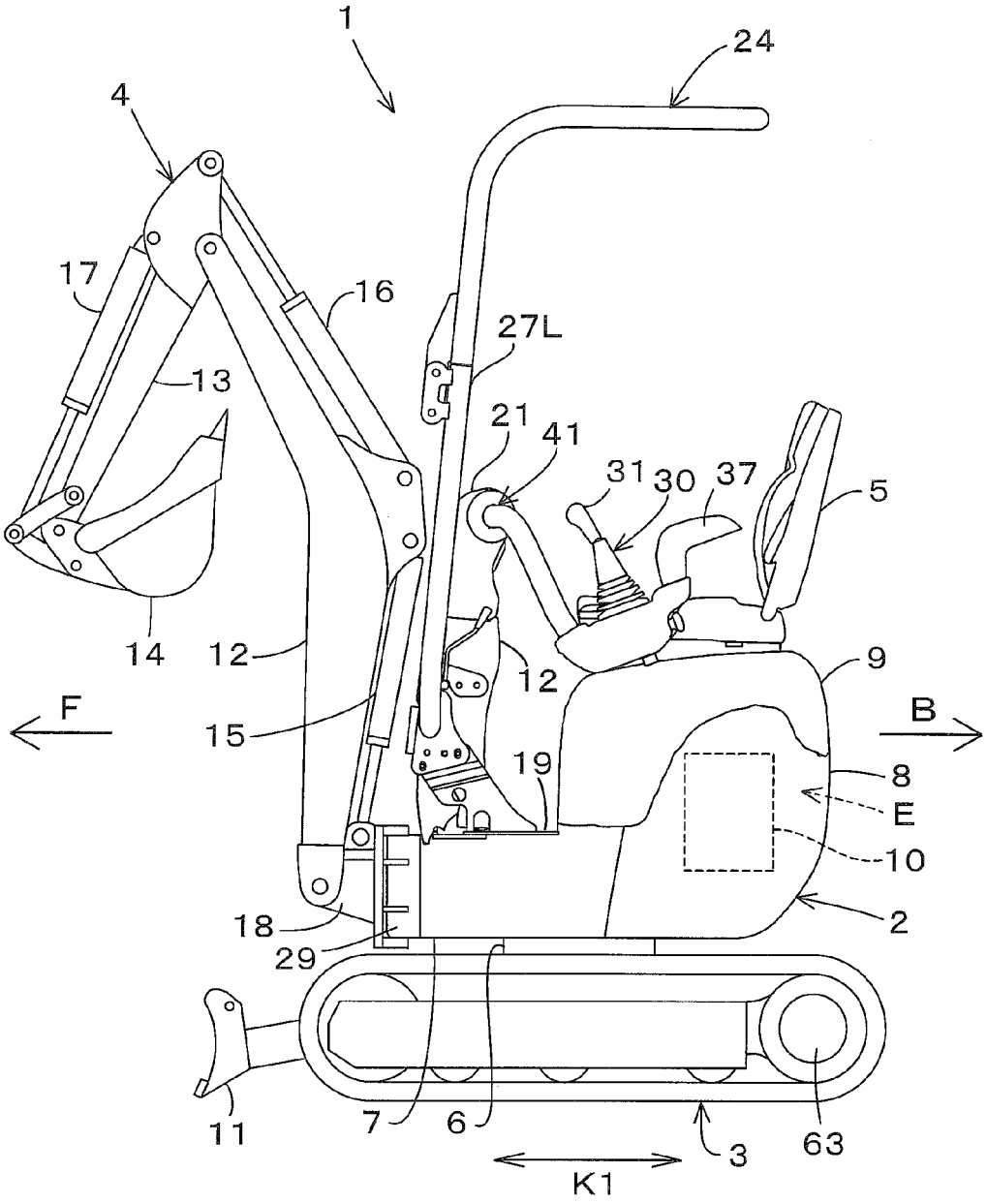
Figure 26:
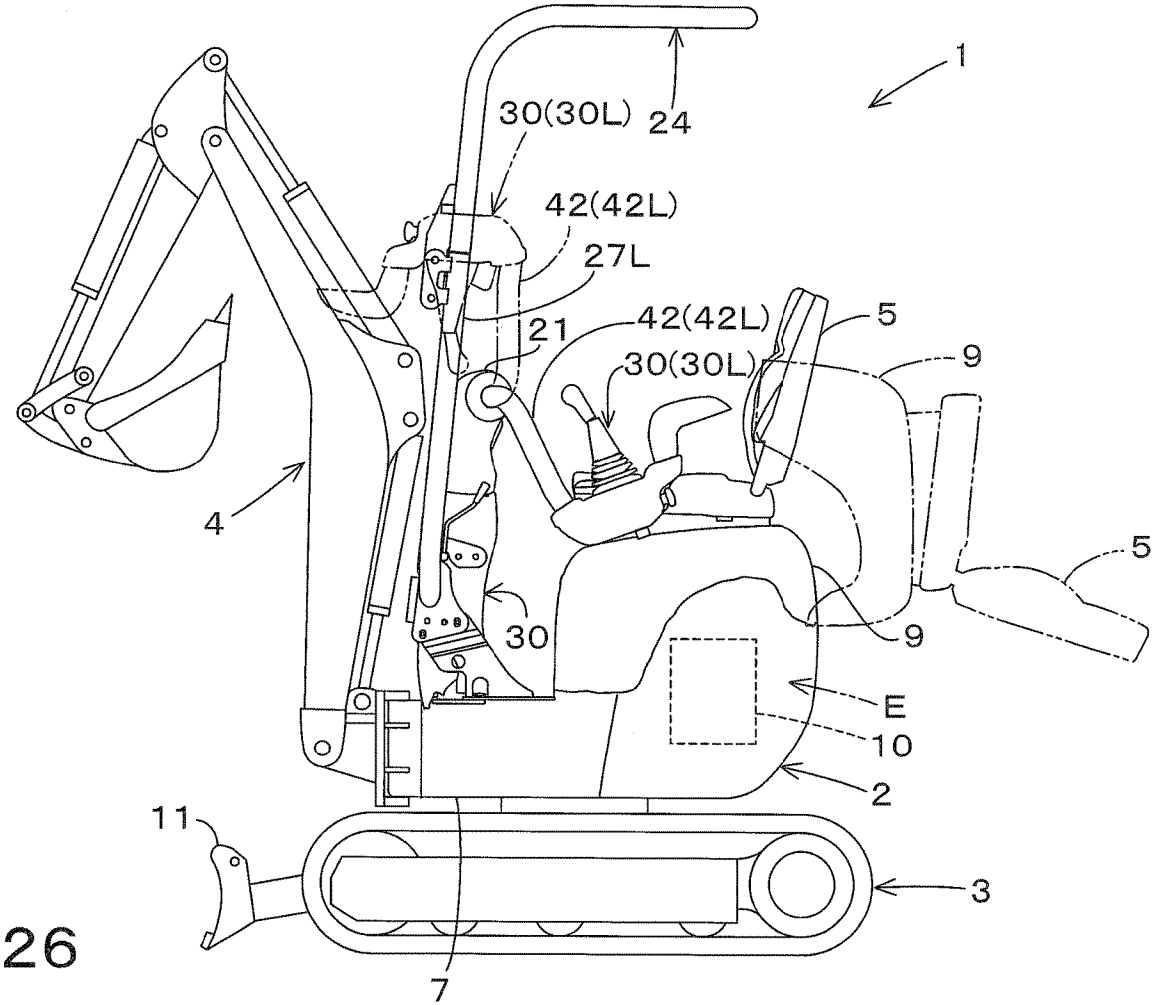
FIG. 26 is a view showing a state of a bonnet (hood) turned backward.

FIG. 25 is a schematic diagram showing an overall configuration of a work machine 1 according to an embodiment of the present invention, and exemplifies a compact backward-swiveling backhoe (a mini excavator) that is a swiveling work machine The work machine 1 includes a machine body 2, a travel device 3, and a working device 4. An operator seat 5 is disposed on the machine body 2. Hereinafter, in explanations of the embodiment of the present invention, a forward direction (a direction shown by an arrowed line F in FIG. 25) corresponds to a front side of an operator seating on the operator seat 5 of the work machine 1, a backward direction (a direction shown by an arrowed line B in FIG. 25) corresponds to a back side of the operator, a leftward direction (a direction vertically extending from a back surface to a front surface of FIG. 25) corresponds to a left side of the operator, and a rightward direction (a direction vertically extending from the front surface to the back surface of FIG. 25) corresponds to a right side of the operator. Additionally, in the following description, a horizontal direction K2 (refer to FIG. 24) is a machine width direction, the horizontal direction K2 being perpendicular to a front to rear direction (a rear to front direction) K1 (refer to FIG. 25). Moreover, in the following description, a direction from a center portion of the machine body 2 toward the above mentioned right side can be referred to as an outward direction. And, a direction from the center portion of the machine body 2 toward the above mentioned left side can be also referred to as the outward direction. The outward direction is hereinafter referred to as a machine outward direction. In other words, the machine outward direction corresponds to a direction departing from the center portion of the machine body 2 in the machine width direction. A direction opposite to the machine outward direction can be referred to as an inward direction. The inward direction is hereinafter referred to as a machine inward direction. In other words, the machine inward direction corresponds to a direction toward the center portion of the machine body 2 in the machine width direction The machine body 2 includes a turn base 7, and the turn base 7 is supported by a bearing 6 on a frame of the travel device 3, being capable of freely turning about a vertical axis of the bearing 6. The turn base 7 is turned by a driving force of a turn motor (not shown in the drawings) configured of a hydraulic motor. The working device 4 is attached on a front portion of the turn base 7. A counter weight 8 is attached on a rear portion of the turn base 7, the counter weight balancing a weight of the working device 4. The rear portion of the turn base 7 is covered with a bonnet (a hood) 9.

An upper surface of the bonnet 9 is an inclined surface inclining backwardly higher from the front thereof, and the operator seat 5 is mounted on the upper surface. An engine room E is disposed under the bonnet 9. An engine 10, a hydraulic pump (not shown in the drawings), an operation fluid tank (not shown in the drawings), and the like are arranged in the engine room E. The bonnet 9 is pivotally supported at a rear lower portion of the bonnet 9, being capable of turning about a horizontal axis on the counter weight 8.

The travel device 3 is configured of a crawler travel device, for example. The travel device 3 is disposed on a lower portion of a right side of the machine frame 2, and another travel device 3 is disposed on a lower portion of a left side of the machine frame 2. The travel device 3 is driven by a travel motor 63 configured of a hydraulic motor. A dozer 11 is disposed in front of the travel devices 3. The dozer 11 is driven by a dozer cylinder (not shown in the drawings).

The working device 4 includes a boom 12, an arm 13, and a working tool (a bucket) 14. The working device 4 further has a drive mechanism for the boom, arm, and the like, and the drive mechanism includes a boom cylinder 15, an arm cylinder 16, and a working tool cylinder 17. The boom cylinder 15, the arm cylinder 16, the working tool cylinder 17, and the dozer cylinder are each constituted of a hydraulic cylinder. The hydraulic cylinders (hydraulic actuators) are driven by operation fluid, the operation fluid being supplied from the operation fluid tank by the hydraulic pump.

As shown in FIG. 25, a base end portion of the boom 12 is pivotally supported by a bracket 18 disposed on a right front portion of the turn base 7, being capable of freely swinging centering about the horizontal axis. The bracket 18 is pivotally supported by a receiver bracket 29 disposed on the turn base 7, being capable of freely swinging centering about the vertical axis. A swing cylinder (not shown in the drawings) is constituted of a hydraulic cylinder and is attached on the turn base 7. The bracket 18 is swung by the swing cylinder. A base end portion of the arm 13 is pivotally supported on a tip end portion of the boom 12, being capable of freely swinging centering about the horizontal axis. The working tool 14 is attached to a tip end portion of the arm 13.

The boom cylinder 15 connects the bracket 18 to an intermediate portion of the boom 12. The boom cylinder 15 is capable of being stretched and shortened, thereby swinging the boom 12 upward and downward. The arm cylinder 16 connects the intermediate portion of the boom 12 to the base end portion of the arm 13. The arm cylinder 16 is capable of being stretched and shortened, thereby swinging the arm 13 upward and downward. The working tool cylinder 17 connects the base end portion of the arm 13 to an attachment portion of the working tool 14. The working tool cylinder 17 is capable of being stretched and shortened, thereby performing a shoveling movement and a dumping movement.

Figure 3:
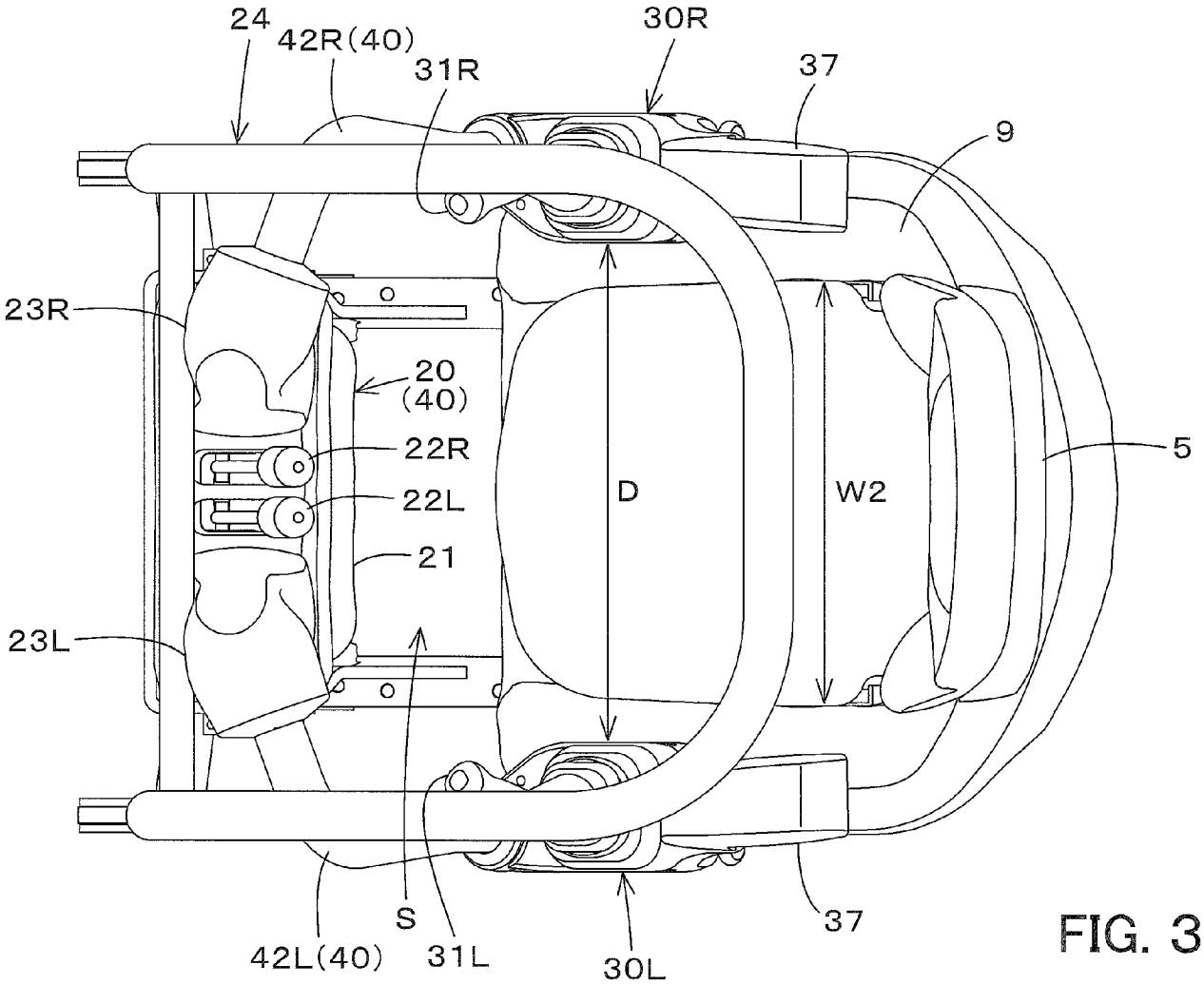
FIG. 3 is a plan view showing the operator seat and the periphery of the operator seat of the work machine according to the embodiment.
Figure 4:
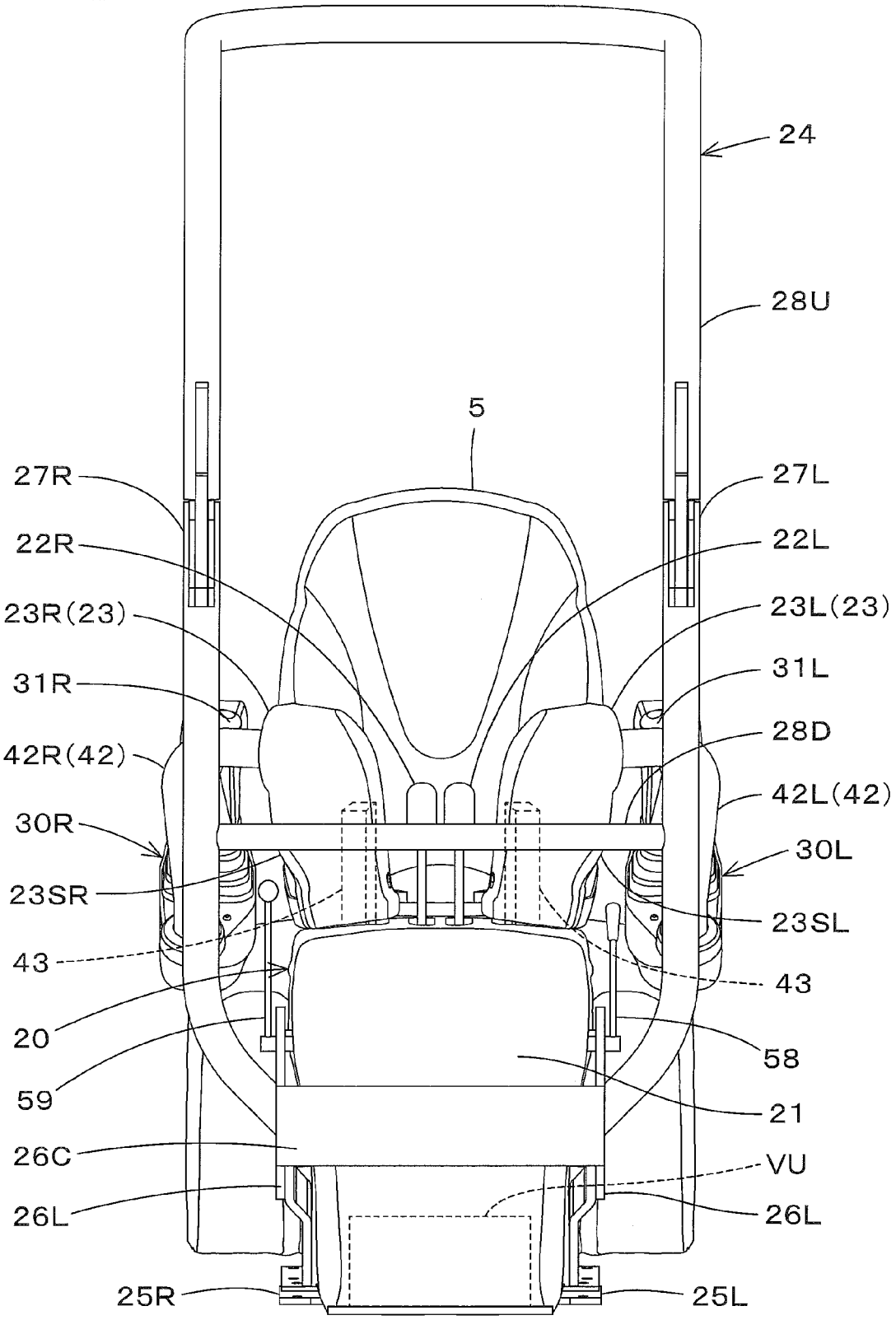
FIG. 4 is a front view showing the operator seat and the periphery of the operator seat of the work machine according to the embodiment.
Figure 11:
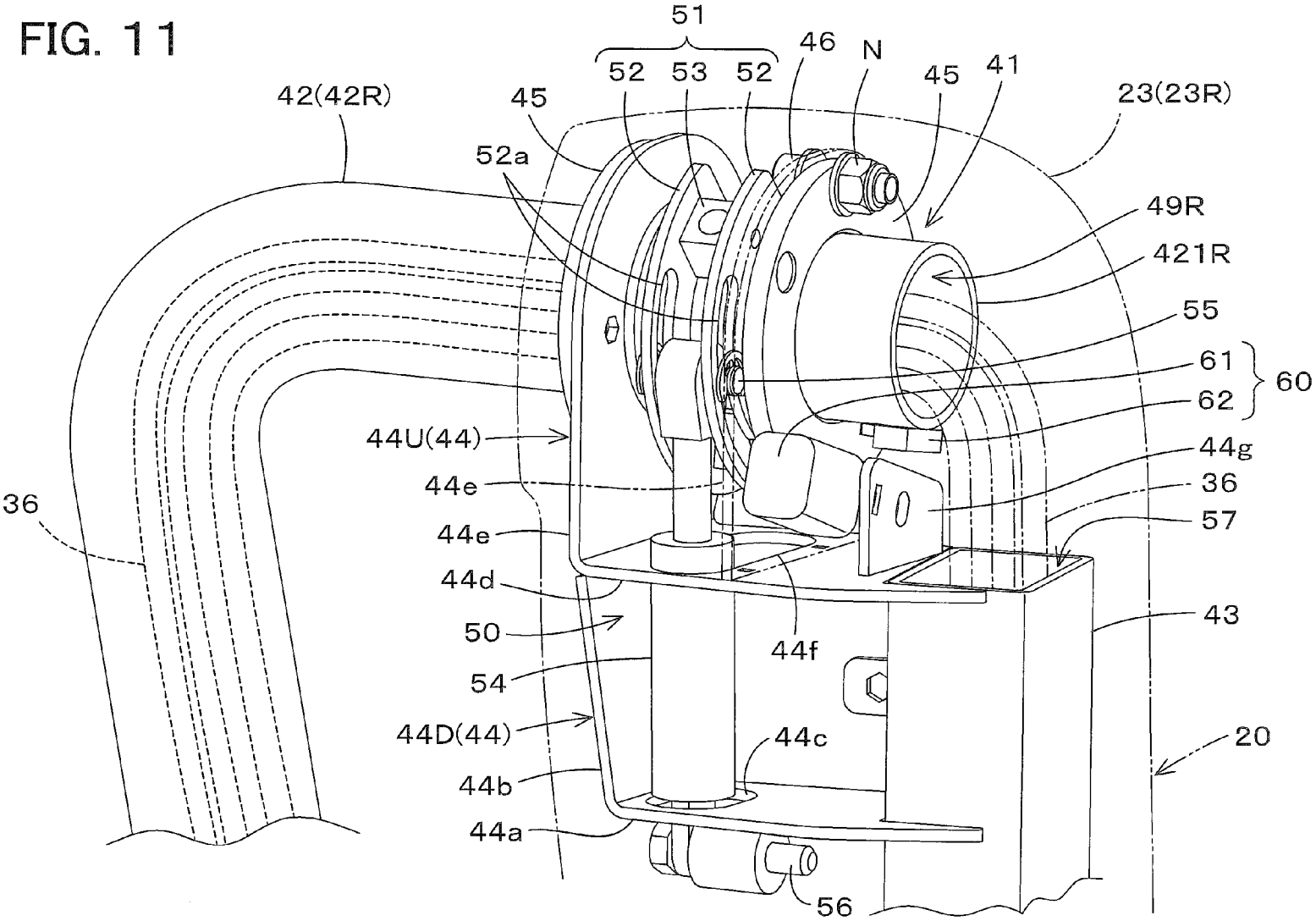
FIG. 11 is a perspective view showing an inner structure of a support mechanism.

A step 19 is disposed on a front portion of the turn base 7. An operation tower 20 is disposed on a front portion of the step 19 in front of the operator seat 5 and the bonnet 9. As shown in FIG. 3, FIG. 4, FIG. 11, and the like, the operation tower 20 includes an operation tower cover 21, a supporting portion 41, and a supporting portion cover 23. In addition, a travel lever 22R and a travel lever 22L are disposed on the operation tower 20, the travel lever 22R and the travel lever 22L each serving as an operation lever.

The travel levers 22R and 22L protrude upward from an upper portion of the operation tower cover 21. The travel lever 22R is a lever used for operating the travel device 3 disposed on the right side. The travel lever 22L is a lever used for operating the travel device 3 disposed on the left side.

Figure 2:
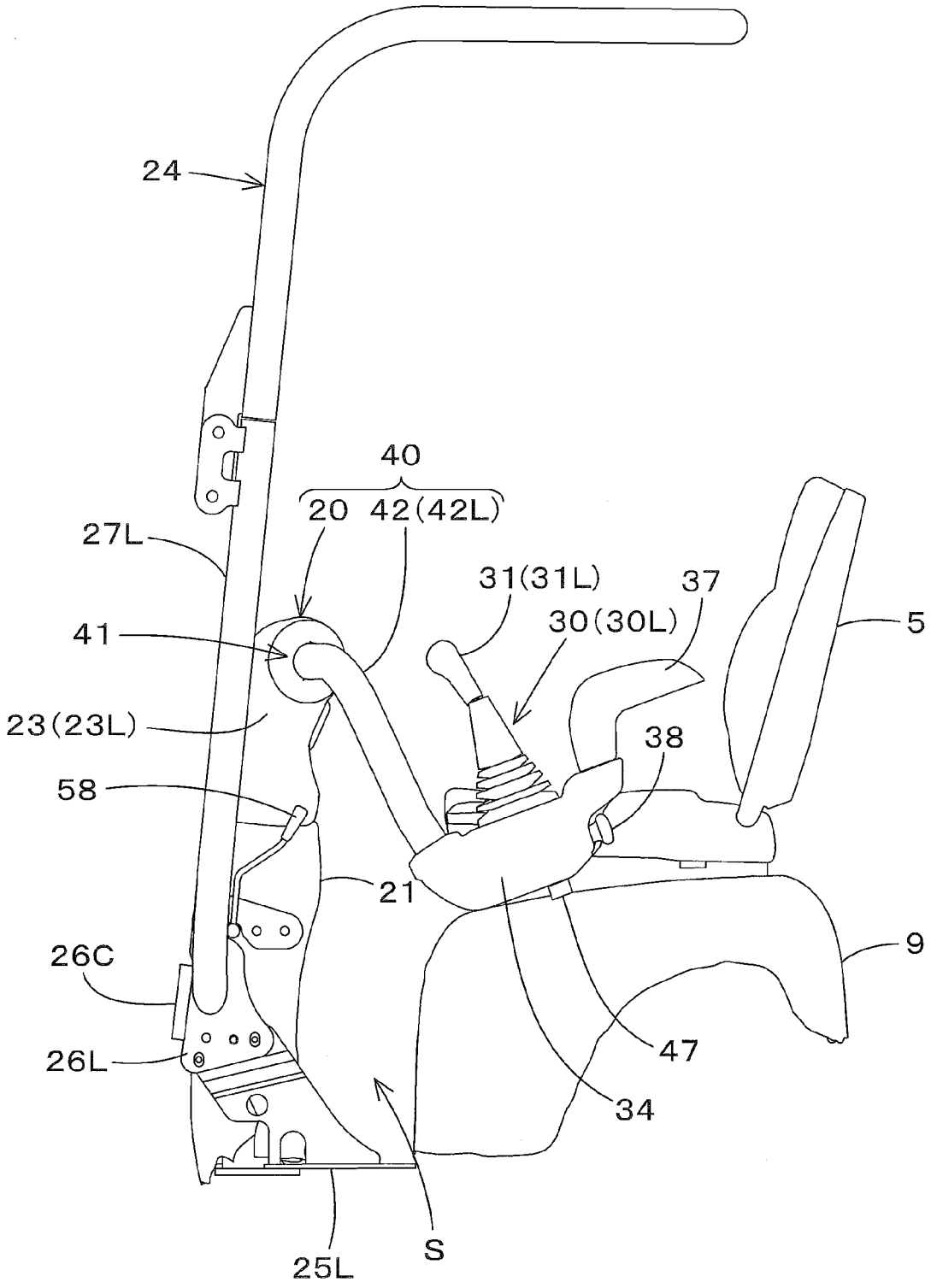
FIG. 2 is a side view showing the operator seat and the periphery of the operator seat of the work machine according to the embodiment.

As shown in FIG. 11, the supporting portion is covered with the supporting portion cover 23. A support arm 42 is supported on the operation tower 20 at a side of one end of the support arm 42 turnably with respect to the operation tower 20. As shown in FIG. 2, FIG. 3, and the like, an operation device 30 is attached on a side of the other end of the support arm 42. Concrete configurations of the supporting portion 41, the support arm 42, and the operation device 30 will be described below. The supporting portion 41 is arranged on a position higher than a seat surface of the operator seat 5. The supporting portion cover 23 includes a support cover 23R and a support cover 23L, the support cover 23R being disposed on the right side, the support cover 23L being disposed on the left side. The support covers 23R and 23L are fixed to the upper portion of the operation tower cover 21. The supporting portion cover 23R is disposed to the right of the travel lever 22R. The supporting portion cover 23L is disposed to the left of the travel lever 22L.

Figure 5:
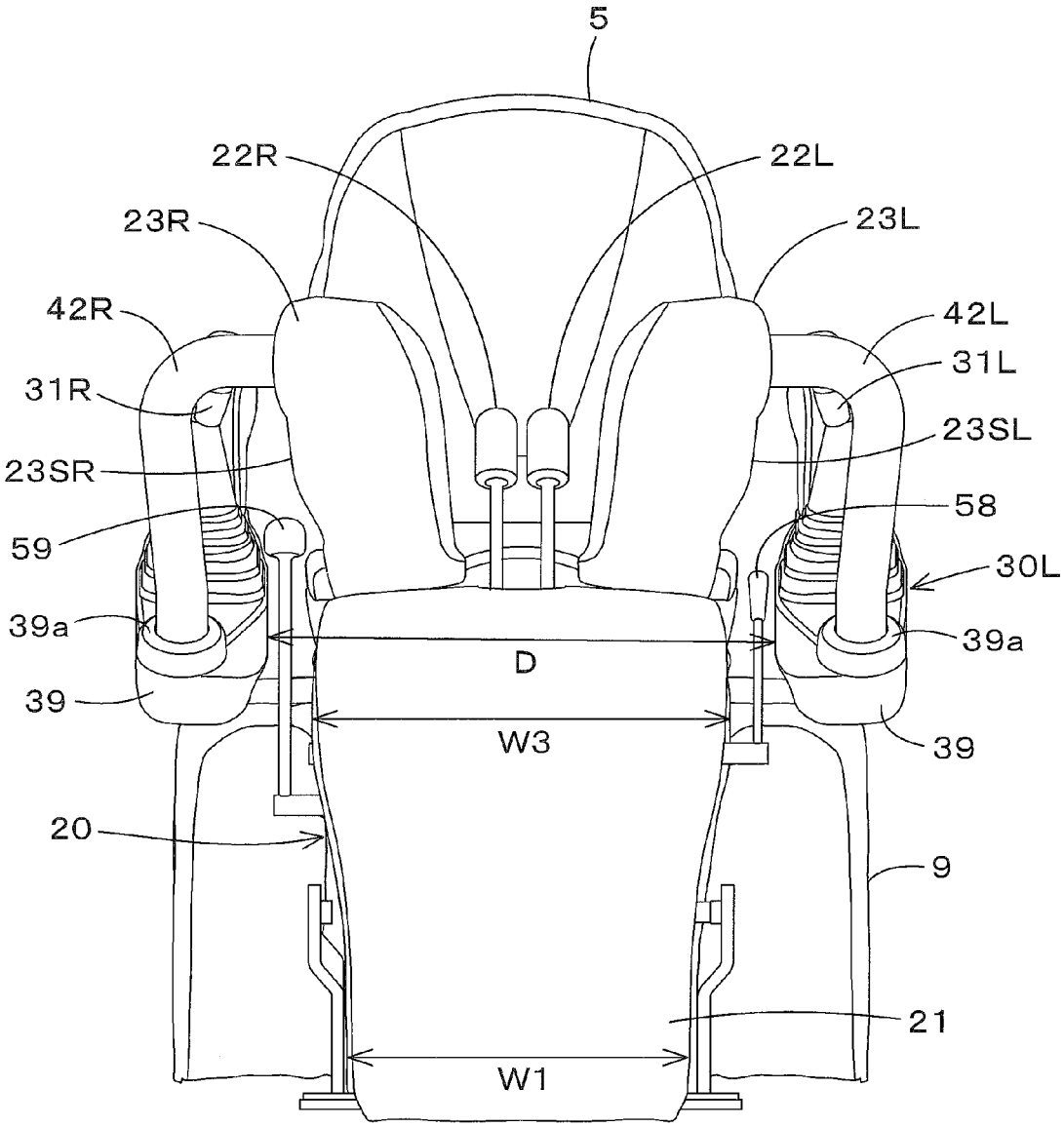
FIG. 5 is a front view showing an operation tower, the operator seat, and peripheries thereof of the work machine according to the embodiment.
Figure 6:
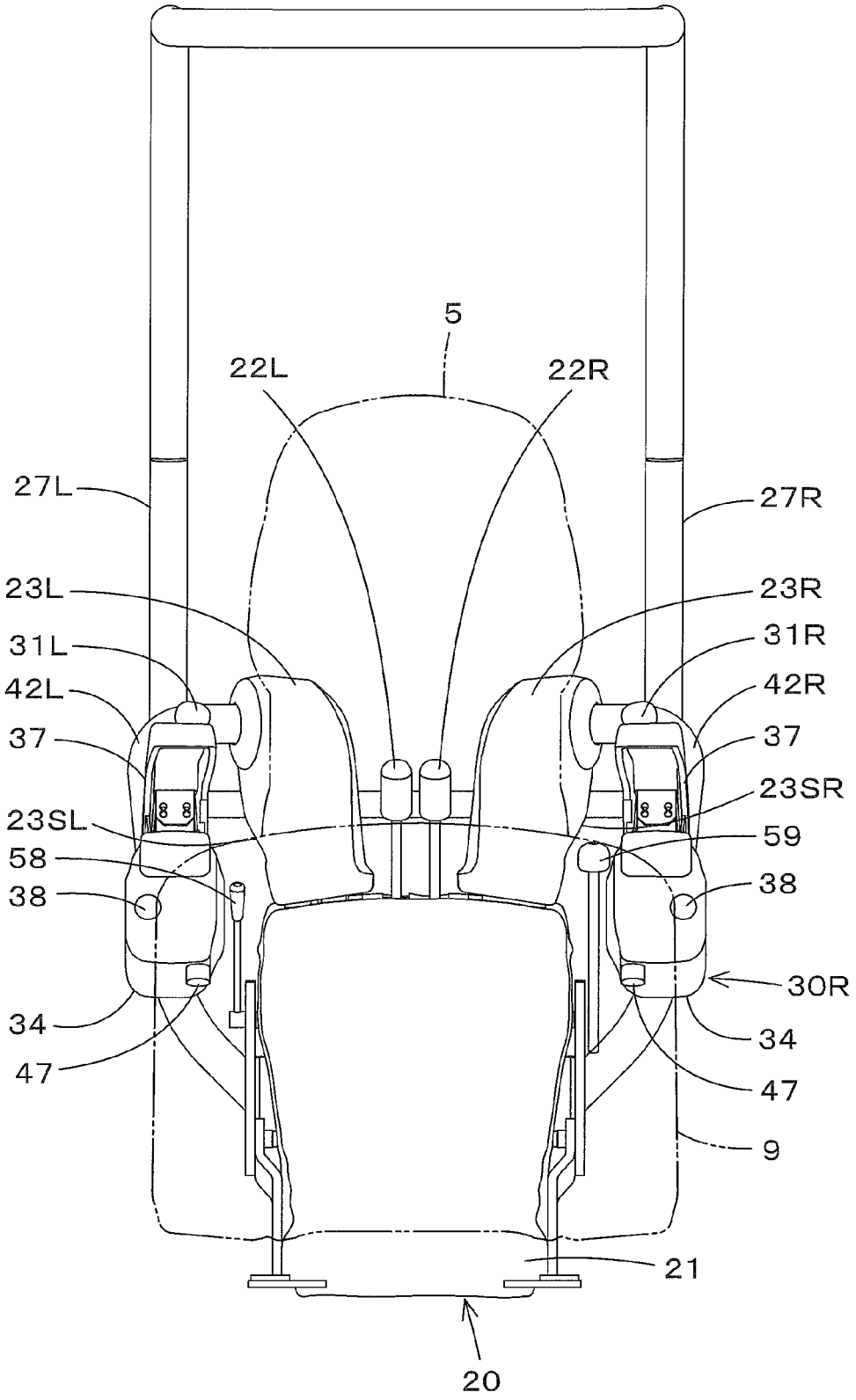
FIG. 6 is a back view showing the operation tower, the operator seat, and peripheries thereof of the work machine according to the embodiment.

As shown in FIG. 4 to FIG. 6, surfaces of the supporting portion covers 23R and 23L are inclined downwardly toward a center of the machine width direction, the surfaces being outsides of the supporting portion covers in the machine width direction. In particular, a right side surface 23SR of the supporting portion cover 23R is inclined downwardly toward the left side in the machine width direction. A left side surface 23SL of the supporting portion cover 23L is inclined downwardly toward the right side in the machine width direction. In this manner, a large space is formed around legs (around knees) of an operator. Additionally, an acceleration lever 58 is disposed in the front left of the operator seat 5, a dozer lever 59 is disposed in the front right of the operator seat 5, and thus the acceleration lever 58 and the dozer lever 59 can be easily operated.

As shown in FIG. 2 and FIG. 3, the operation tower cover 21 is arranged opposed to a front surface of the bonnet 9 with a space S kept between the front surface and the operation tower cover 21. A height of the operation tower cover 21 is higher than a height of the bonnet 9 and is lower than a height of the seat surface of the operator seat 5. As shown in FIG. 4 to FIG. 6, a right side surface and a left side surface (surfaces facing to the machine outward direction) of the operation tower cover 21 is inclined downwardly toward the machine inward direction under the seat surface of the operator seat 5. In this manner, a width of a lower portion of the operation tower cover 21 (a length in the machine width direction) is smaller than a width of an upper portion of the operation tower cover 21. The width W1 of the lower portion of the operation tower cover 21 is narrower than a width (a length in the machine width direction) W2 of the seat surface of the operator seat 5 (refer to FIG. 3). The width (the maximum width) W3 of the upper portion of the operation tower cover 21 is substantially equal to the width W2 of the seat surface of the operator seat 5 and is narrower than a distance D between a first operation device 30R and a second operation device 30L (refer to FIG. 3 and FIG. 5), the first operation device 30R and the second operation device 30L being described later. Thus, the large space is formed around legs (around knees) of the operator.

As shown in FIG. 4, a valve unit VU is arranged in a lower portion of a space under the operation tower cover 21. The valve unit VU is configured by integrating a plurality of control valves arranged in parallel in the machine width direction, the control valves being configured to control hydraulic actuators of the working device 4. The valve unit VU is located to arrange spools of the control valves in a vertical direction and to orient ports of the control valves backward.

The control valves is constituted of: a turn valve for the turn motor; an arm valve for the arm cylinder 16; a boom valve for the boom cylinder 15; a working tool valve for the working tool cylinder 17; travel valves for the travel motor 63 disposed on the right side and the travel motor 63 disposed on the left side; a change valve for changing speeds of the travel motors 63; a dozer valve for the dozer cylinder; and a swing valve for the swing cylinder, for example. Types of the control valves are changed adequately as needed.

Of the control valves, the travel valve, the dozer valve, the change valve, and the swing valve are mechanical control valves given a mechanical operation force from a link and the like. The turn valve, the arm valve, the boom valve, and the working tool valve are hydraulic valves operated by a pressure of a pilot fluid (a pilot oil), the pilot fluid being supplied from the hydraulic pump.

Figure 8:
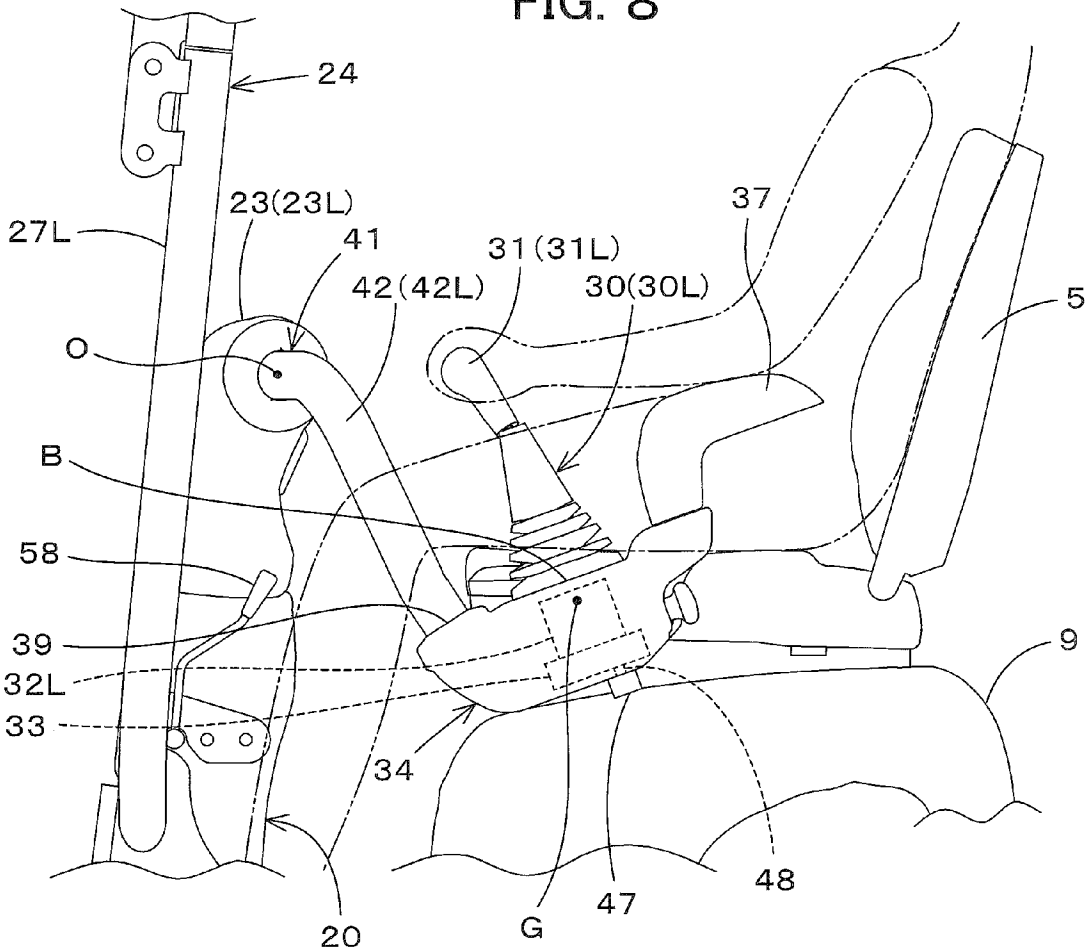
FIG. 8 is an enlarged side view showing the operator seat and the periphery of the operator seat of the work machine according to the embodiment.
Figure 10:
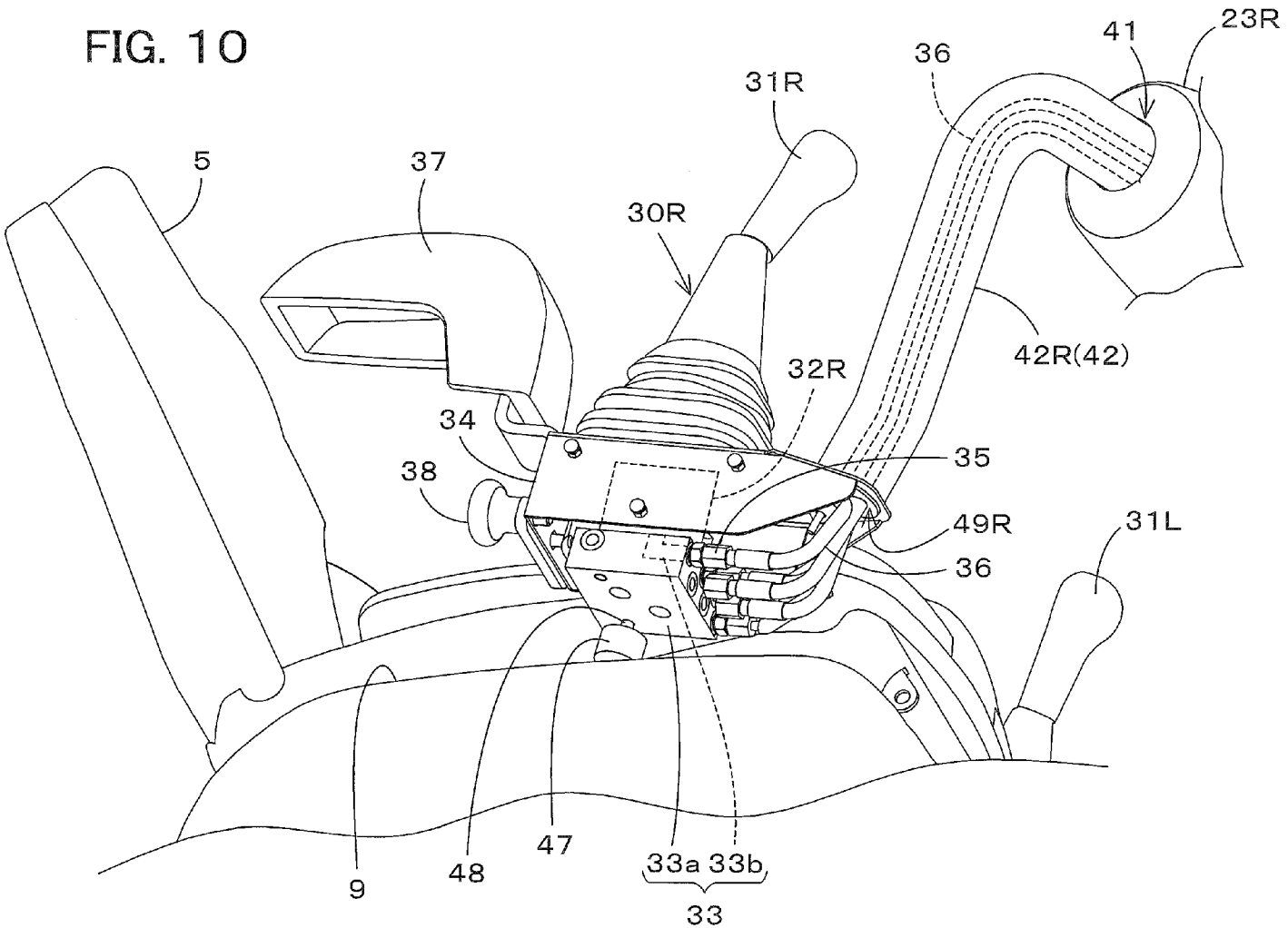
FIG. 10 is a lower perspective view simply showing a lower portion of a casing of an operation device according to the embodiment.

The travel levers 22R and 22L, the acceleration lever 58, and the dozer lever 59 are mechanically connected to the control valves by the links and the like (not shown in the drawings). In particular, the travel levers 22R and 22L are connected to the travel valves. The acceleration lever 58 is connected to the change valve. The dozer lever 59 is connected to the dozer valve. The swing valve is mechanically connected to a swing pedal (not shown in the drawings). In addition, the turn valve, the arm valve, the boom valve, and the working tool valve are connected to a pilot valve (a remote control valve) by hydraulic tubes (pilot hoses). The pilot valve will be described later. In the embodiment, as shown in FIG. 10 and FIG. 8, the pilot valve includes a first pilot valve 32R and a second pilot valve 32L.

A canopy 24 is disposed on the turn base 7, the canopy 24 serving as a protection device for the operator seat.

As shown in FIG. 1, FIG. 4, and the like, the canopy 24 includes bases 25R and 25L, an attachment unit 26, pillars 27R and 27L, and connection members 28D and 28U. The base 25R is arranged to the right of the operation tower 20, the base 25R being disposed on the right side. The base 25L is arranged to the left of the operation tower 20, the base 25L being disposed on the left side. Lower portions of the bases 25R and 25L are fixed to an upper surface of the step 19. The attachment unit 26 is attached to upper portions of the bases 25R and 25L.

The attachment unit 26 includes a right member 26R, a left member 26L, and a coupling member 26C. The right member 26R is attached to the base 25R. The left member 26L is attached to the base 25L. The coupling member 26C couples the right member 25R and the left member 25L to each other in front of the operation tower 20. The dozer lever 59 is attached to the right member 26R of the attachment unit 26. The acceleration lever 58 is attached to the left member 26L of the attachment unit 26. The acceleration lever 58 is used for controlling a speed of the engine 10. The dozer lever 59 is used for driving the dozer cylinder, thereby swinging the dozer 11 upward and downward.

The pillars 27R and 27L are disposed in front of the operator seat 5, being separated from each other in the machine width direction. A lower end portion of the pillar 27R is fixed to the right member 26R of the attachment unit 26, the pillar 27R being disposed on the right side. A lower end portion of the pillar 27L is fixed to the left member 26L of the attachment unit 26, the pillar 27L being disposed on the left side. The pillar 27R and the pillar 27L extend upwardly and are parallel to each other.

The coupling member 28D and 28U couple the pillar 27R and the pillar 27L to each other. The coupling member 28U extends upwardly from each of upper end portions of the pillar 27R and the pillar 27L, bents and extends backwardly, and then forms a loop above the operator seat 5. The coupling member 28D couples the pillar 27R and the pillar 27L to each other in front of the supporting portion covers 23R and 23L.

As shown in FIG. 1 to FIG. 4 and the like, the operation devices 30 are each arranged to the sides of the operator seat 5 above the bonnet 9. The operation device 30 is supported by a support mechanism 40, being capable of positional change. As described later, the support mechanism 40 supports the operation device 30 at a first position being on a side of the operator seat 5 (refer to FIG. 1 to FIG. 10) and at a second position being more forward than the operator seat 5 above the first position (refer to FIG. 21 to FIG. 23). With the exception of a case particularly mentioned, positional relations between the components will be explained later referring to the operation device 30 located on the first position.

The operation device 30 includes the first operation device 30R and the second operation device 30L. The first operation device 30R is arranged on one end side (the right side) of the operator seat 5. The second operation device 30L is arranged on the other end side (the left side) of the operator seat 5.

The first operation device 30R includes major configurations similar to major configurations of the second operation device 30L, and accordingly the major configurations of the first operation device 30R will be explained firstly based on FIG. 10. As for the second operation device 30L, only configurations different from the configurations of the first operation device 30R will be explained, and the configurations included in the first operation device 30R will be omitted from the explanation.

The first operation device 30R is a device for operation of the boom and bucket. As shown in FIG. 10, the first operation device 30R includes a first operation lever 31R, a first pilot valve 32R, a manifold 33, and a casing 34.

The first operation lever 31R is attached to an upper portion of the casing 34, and is configured to be swung forward, backward, rightward, and leftward. The first pilot valve 32R and the manifold 33 are housed in the casing 34.

The first pilot valve 32R is arranged under the first operation lever 31R, and is operated by the first operation lever 31R. The manifold 33 is arranged under the first pilot valve 32R, and is connected to the first pilot valve 32R by the hydraulic tubes (not shown in the drawings). The manifold 33 includes a block 33*a* and a fluid path (fluid tube) 33*b*, the block 33*a* having a rectangular parallelepiped shape, the fluid path 33*b* being formed in the block 33*a*. The fluid path 33*b* is formed to have an L-shape in the block 33*a*, thus connecting an upper port and a front port to each other, the upper port being disposed on an upper surface of the block 33*a*, the front port being disposed on a front surface of the block 33*a*. In this manner, a thickness (a height) of the manifold 33 can be small, thereby suppressing a thickness (a height) of the casing 34. The upper port of the block 33*a* is connected to the first pilot valve 32R. One end portion of a hydraulic tube 36 is connected to the front port of the block 33*a* by a joint tube (a joint pipe) 35. The hydraulic tube 36 is a hydraulic hose for supplying the pilot fluid. The other end portion of the hydraulic tube 36 is connected to the boom valve and working tool valve of the valve unit VU. In particular, the first pilot valve 32R is connected to the boom valve and to the working tool valve by the manifold 33 and the hydraulic tube 36.

The second operation device 30L is a device for operation of the turn and arm. As shown in FIG. 8, the second operation device 30L includes a second operation lever 31L, a second pilot valve 32L, the manifold 33, and the casing 34. The second pilot valve 32L and the manifold 33 are housed in the casing 34. The second pilot valve 32L is arranged under the second operation lever 31L, and is operated by the second operation lever 31L. The second pilot valve 32L is connected to the turn valve and to the arm valve by the manifold 33 and a hydraulic tube (not shown in the drawings).

A wrist rest 37 is attached to the upper portion of the casing 34. The wrist rest 37 is disposed behind the first operation lever 31R, and another wrist rest 37 is disposed behind the second operation lever 31L. The wrist rest 37 extends upward from the upper surface of the casing 34, and bents and extends backwardly. As shown by a virtual line (a two-dot chain line) in FIG. 8, the operator is capable of operating the first operation lever 31R and the second operation lever 31L, seating on the operator seat 5 and putting the arms on the wrist rest 37.

A grip 38 is attached to a rear portion of the casing 34. The grip 38 is formed of a knob having a head portion, the head portion having a flattened ball shape. The grip 38 is positioned under the wrist rest 37, and protrudes backward from a rear surface of the casing 34. The operator is capable of easily locating (turning) the operation device 30 on the first position and on the second position when grasping the grip 38.

Figure 7:
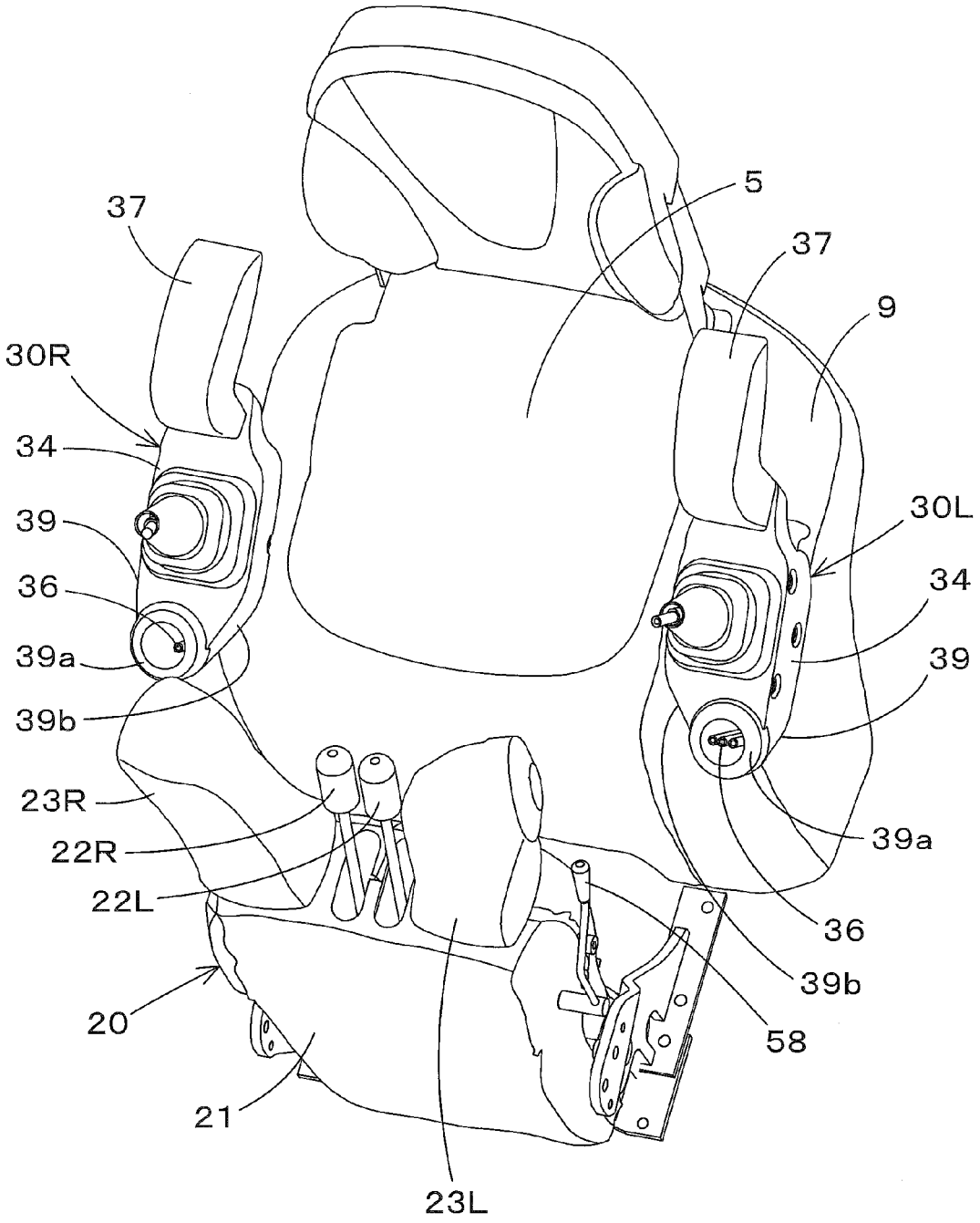
FIG. 7 is a perspective view showing the operation tower, the operator seat, and peripheries thereof of the work machine according to the embodiment.
Figure 9:
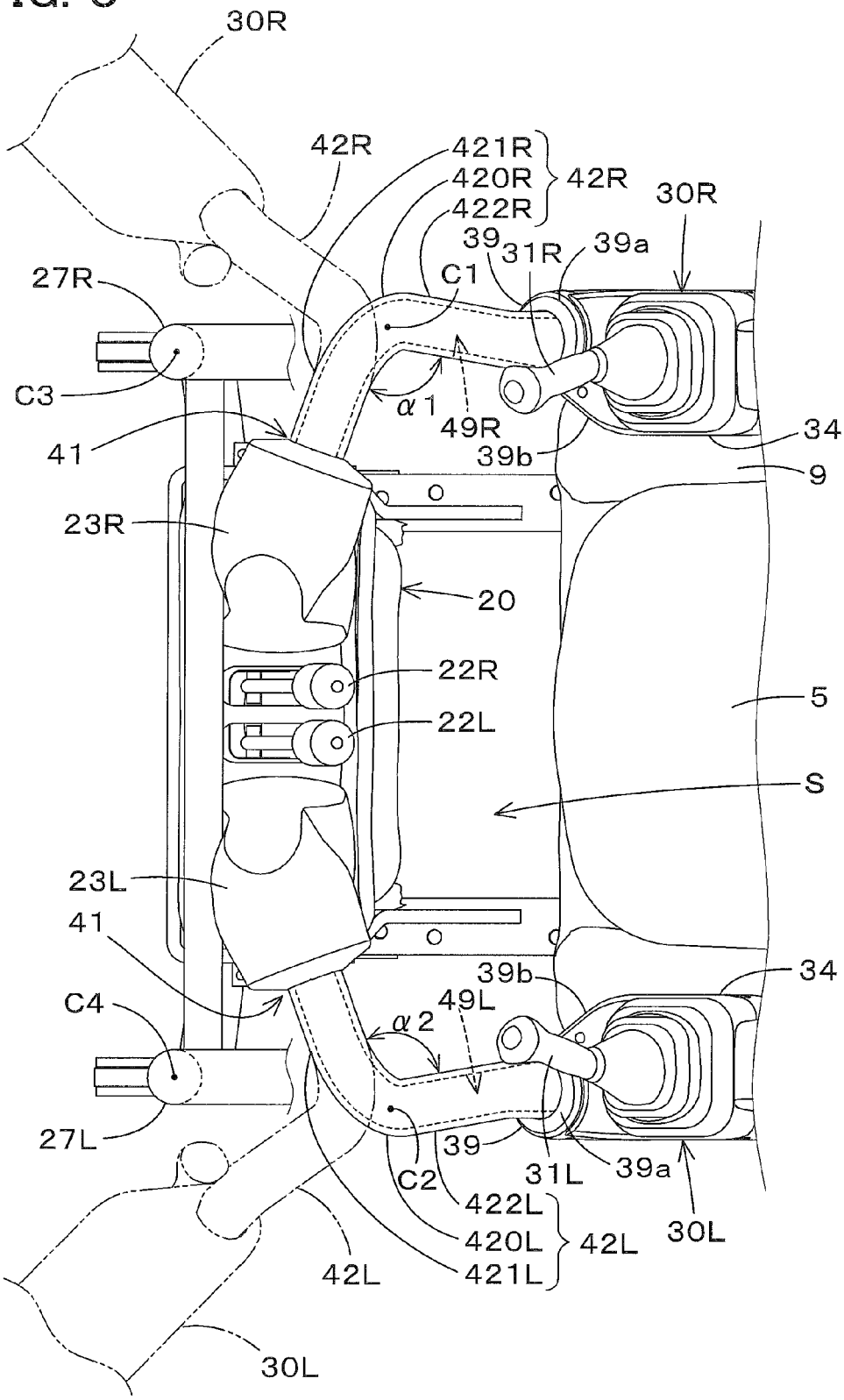
FIG. 9 is an enlarged plan view showing the operator seat and the periphery of the operator seat of the work machine according to the embodiment.

As shown in FIG. 7 to FIG. 9, the casing 34 has a forward extending portion 39 extending forward from the first operation lever 31R, and another casing 34 has another forward extending portion 39 extending forward from the second operation lever 31L. An upper surface of the forward extending portion 39 is inclined downwardly extending forward, and is provided with a connecting portion 39*a* (refer to FIG. 7) having a cylindrical shape opened upwardly. As shown in FIG. 9, the side of the other end of the support arm 42 is connected to the connecting portion 39. The hydraulic tube 36 connected to the joint tube 35 of the manifold 33 is drawn upwardly from the casing 34, passing through the opening of the connecting portion 39*a*, and is introduced into insertion paths 49R and 49L formed in the support arms 42. The insertion paths 49R and 49L will be described later. A lower portion of the forward extending portion 39 is inclined upwardly extending forward.

As shown in FIG. 7 and FIG. 9, a side portion 39*b* of the forward extending portion 39 extends forward diagonally departing from the operation seat 5 gradually, the side portion being disposed on a side of the operator seat 5. In other words, the forward extending portion 39 is chamfered on the side portion disposed on the side of the operator seat 5. In this manner, a large space can be formed around legs (around knees) of the operator seating on the operator seat 5.

As shown in FIG. 8, FIG. 10, and the like, a shock-absorbing member 47 is disposed on a lower portion of the casing 34. The shock-absorbing member 47 is formed of an elastic member such as rubber, and is formed to have a cylindrical shape. The shock-absorbing member 47 is fixed to the manifold 33 by a screw 48. The screw 48 protrudes downward from a lower surface of the casing 34, and the shock-absorbing member 47 is attached to the protruding portion. A position of the shock-absorbing member 47 (a distance from the lower surface of the casing 34) can be adjusted by screwing the screw 48. The shock-absorbing member 47 contacts to the upper surface of the bonnet 9 when the operation device 30 is on the first position, the bonnet 9 being disposed on a lateral side of the operator seat 5. In this manner, the casing 34 is prevented from hitting directly and strongly the upper surface of the bonnet 9 in moving the operation device 30 from the second position to the first position.

The support mechanism 40 includes a support member and the support arm 42, the support member being disposed around the operator seat 5, the support arm 42 being turnably supported by the support member.

In the embodiment, the operation tower 20 is employed as the support member, the operation tower 20 being disposed in front of the operator seat 5. However, an embodiment of the present invention does not limit the support member to the operation tower 20, and, for example, may employ the pillars 27R and 27L of the canopy 24 as the support member. In addition, another support member may be employed other than the operation tower 20 and the pillars 27R and 27L. The following explanation will describe a case where the operation tower 20 is employed as the support member.

The support arm 42 includes a first support arm 42R and a second support arm 42L. The first support arm 42R is turnably supported on one side (the right side) of the operation tower 20. The second support arm 42L is turnably supported on the other side (the left side) of the operation tower 20. To be detailed, one end portion of the first support arm 42R is turnably supported by the supporting portion 41 in an inner space under the support portion cover 23R, the support portion cover 23R being disposed on the right side. In addition, one end portion of the second support arm 42L is turnably supported by the supporting portion 41 in an inner space under the support portion cover 23L, the support portion cover 23L being disposed on the left side.

The first operation device 30R is attached to the other end portion of the first support arm 42R. In particular, the other end portion of the first support arm 42R is connected to the connecting portion 39*a* included in the forward extending portion 39, the forward extending portion 39 being included in the casing 34 of the first operation device 30R. The second operation device 30L is attached to the other end portion of the second support arm 42L. In particular, the other end portion of the second support arm 42L is connected to the connecting portion 39*a* included in the forward extending portion 39, the forward extending portion 39 being included in the casing 34 of the second operation device 30L.

In this manner, the first operation device 30R changes a position thereof between the first position and the second position when the first support arm 42R turns about the supporting portion 41 serving as a fulcrum. In addition, the second operation device 30L changes a position thereof between the first position and the second position when the second support arm 42L turns about the supporting portion 41 serving as a fulcrum.

As shown in FIG. 9, the first support arm 42R includes a first extending portion 421 R and a second extending portion 422R, the first extending portion 421 R extending from the supporting portion 41, the second extending portion 422R bending at the first extending portion 421R and extending toward the first operation device 30R. That is, the first support arm 42R bends at an intermediate portion 42OR formed from the supporting portion 41 to the first operation device 30R. The second support arm 42L includes a first extending portion 421L and a second extending portion 422L, the first extending portion 421L extending from the supporting portion 41, the second extending portion 422L bending at the first extending portion 421L and extending toward the second operation device 30L. That is, the second support arm 42L bends at an intermediate portion 420L formed from the supporting portion 41 to the second operation device 30L. The first extending portion 421R of the first support arm 42R and the first extending portion 421L of the second support arm 42L are gradually separated from each other, extending from the supporting portion 41. And, a bending center C1 of the intermediate portion 420R is located outer than an axis C3 of the pillar 27R in the machine outward direction, and a bending center C2 of the intermediate portion 420L is located outer than an axis C4 of the pillar 27L in the machine outward direction. In addition, at the first position, an angle $\alpha 1$ formed between the first extending portion 421R and the second extending portion 422R in the machine inward direction is 90 degrees or more, and an angle $\alpha 2$ formed between the first extending portion 421L and the second extending portion 422L in the machine inward direction is also 90 degrees or more. According to the configurations, the first operation device 30R and the second operation device 30L are prevented from hitting the pillars 27R and 27L in turning the first operation device 30R and the second operation device 30L from the first position to the second position. That is, as shown by a virtual line (a two-dot chain line) in FIG. 9 and shown in FIG. 22, the first support arm 42R and the second support arm 42L evacuate the first operation device 30R and the second operation device 30L to a lateral side of the pillars 27R and 27L at the second position.

As shown in FIG. 9 and FIG. 11, the first support arm 42R includes the insertion path 49R where the hydraulic tube 36 is laid, the hydraulic tube 36 being connected to the first pilot valve 32R. As shown in FIG. 9 and FIG. 10, the second support arm 42L includes the insertion path 49L where the hydraulic tube 36 is laid, the hydraulic tube 36 being connected to the second pilot valve 32L. In the embodiment, the first support arm 42R and the second support arm 42L are formed of a cylindrical pipe, and inner spaces of the first support aim 42R and the second support arm 42L respectively serve as the insertion paths 49R and 49L.

As described above, the operation tower 20 includes the supporting portion 41 configured to turnably support the first support arm 42R and the second support arm 42L. As shown in FIG. 11, the supporting portion 41 includes a support pole 43 and a support bracket 44. Meanwhile, FIG. 11 shows the supporting portion 41 disposed on the operation tower 20, the operation tower 20 being arranged on the right side, and another supporting portion 41 is disposed on the operation tower 20 arranged on the left side. The support pole 43 and the support bracket 44 are covered with the supporting portion cover 23.

As shown in FIG. 4, the support pole 43 protrudes from the upper portion of the operation tower cover 21 and extends upward. The support pole 43 disposed on the left side is arranged left to the travel lever 22L. The support pole 43 disposed on the right side is arranged right to the travel lever 22R. As shown in FIG. 11, the support pole 43 includes an insertion path 57 where the hydraulic tube 36 is laid. In the embodiment, the support pole 43 is formed of a square pipe, and an inner space of the square pipe serves as the insertion path 57. A lower portion of the support pole 43 extends into the inner space under the operation tower cover 21. In this manner, the hydraulic tube 36 can be arranged from an upper portion of the support pole 43 toward the inner space under the operation tower cover 21.

The hydraulic tube 36 is connected to the control valve of the valve unit VU, the valve unit VU being arranged in the inner space under the operation tower cover 21. In particular, the hydraulic tube 36 connected to the first pilot valve 32R passes through the insertion path 49R in the first support arm 42R, enters the inner space under the supporting portion cover 23R, passes through the insertion path 57 in the support pole 43 disposed on the right side, extends downward, enters an inner space under the operation tower cover 21, and is connected to the boom valve and working tool valve of the valve unit VU. The hydraulic tube 36 connected to the second pilot valve 32L passes through the insertion path 49L in the second support arm 42L, enters the inner space under the supporting portion cover 23L, passes through the insertion path 57 in the support pole 43 disposed on the left side, extends downward, enters an inner space under the operation tower cover 21, and is connected to the turn valve and arm valve of the valve unit VU.

As described above, the hydraulic tube (the pilot hose) connecting the pilot valve and the control valve to each other extends from the inner space of the casing 34 to the control valve of the valve unit VU, passing through the insertion paths 49R and 49L of the first support arm 42R and the second support arm 42L and through the insertion paths 57 of the support poles 43. In this manner, the hydraulic tube is internally arranged without being exposed to the outside.

As shown in FIG. 11, the support bracket 44 is attached to the upper portion of the support pole 43. The support bracket 44 disposed on the right side supports the first support arm 42R. The support bracket disposed on the left side (not shown in the drawings) supports the second support arm 42L. The support bracket 44 disposed on the right side includes configurations similar to configurations of the support bracket disposed on the left side. Thus, the configurations of the support bracket 44 disposed on the right side will be explained based on FIG. 11, and the configurations of the support bracket disposed on the left side will be omitted.

The support bracket 4 includes a lower bracket 44D and an upper bracket 44U.

The lower bracket 44D includes a lower horizontal plate 44*a* and a lower vertical plate 44*b*. The lower horizontal plate 44*a* is fixed to the support pole 43 at a position closer to the upper portion of the support pole 43, and is extended toward the machine outward direction (a left side in FIG. 11). The lower horizontal plate 44*a* includes a looped rim forming a lower elongated hole 446*c*, the looped rim being elongated in the front to rear direction (the rear to front direction). The lower vertical plate 44*b* is extended upward from the lower horizontal plate 44*a* on a side being toward the machine outward direction.

The upper bracket 44U is arranged above the lower bracket 44D. The upper bracket 44U includes an upper horizontal plate 44*d* and a pair of upper vertical plates 44*e*. For the convenience of the description of drawings, FIG. 11 shows one of the upper vertical plates 44*e* (on a side being toward the machine inward direction) by using a vertical line.

The upper horizontal plate 44*d* is fixed to the support pole 43 at a position closer to the upper portion of the support pole 43, and is extended toward the machine outward direction. The upper horizontal plate 44*d* includes a looped rim forming an upper elongated hole 44*f*, the looped rim being elongated in the front to rear direction (the rear to front direction). The upper horizontal plate 44*d* is arranged parallel to the lower horizontal plate 44*a*. An attachment plate 44*g* is fixed to an upper surface of the upper horizontal plate 44*d*. A sensor 61 of a switch 60 is attached to the attachment plate 44*g*. The switch 60 will be described later. The looped rim forming the upper elongated hole 44*f* is arranged above the lower elongated hole 44*c*, and is formed to be longer in the front to rear direction (the rear to front direction) than the looped rim forming the lower elongated hole 44*c*.

The pair of upper vertical plates 44*e* are arranged by keeping an interval in the machine width direction, facing across the looped rim forming the lower elongated hole 44*c*, and is extended upward from the upper horizontal plate 44*d*. A bush 45 having a circular shape is fixed to one of the upper vertical plates 44*e*, and another bush 45 is fixed to the other one of the upper vertical plates 44*e*. That is, a pair of the bushes 45 are disposed by keeping an interval in the machine width direction. Each of the pair of upper vertical plates 44*e* includes a looped rim forming a hole, and one end side of the first support arm 42R is inserted to the hole and the bushes 45.

A restriction member 46 is fixed to an upper portion of a side surface of the bush 45, of the pair of bushes 45, disposed on a side being toward the machine inward direction, the restriction member 46 being configured to restrict a position of the first support arm 42R turned upward. The restriction member 46 is disposed protruding toward the interval between the pair of upper vertical plates 44*e*. In the embodiment, the restriction member 46 is formed of a cylindrical head portion of a bolt, and the bolt is fixed to the bush 45 by a nut N.

Figure 12:
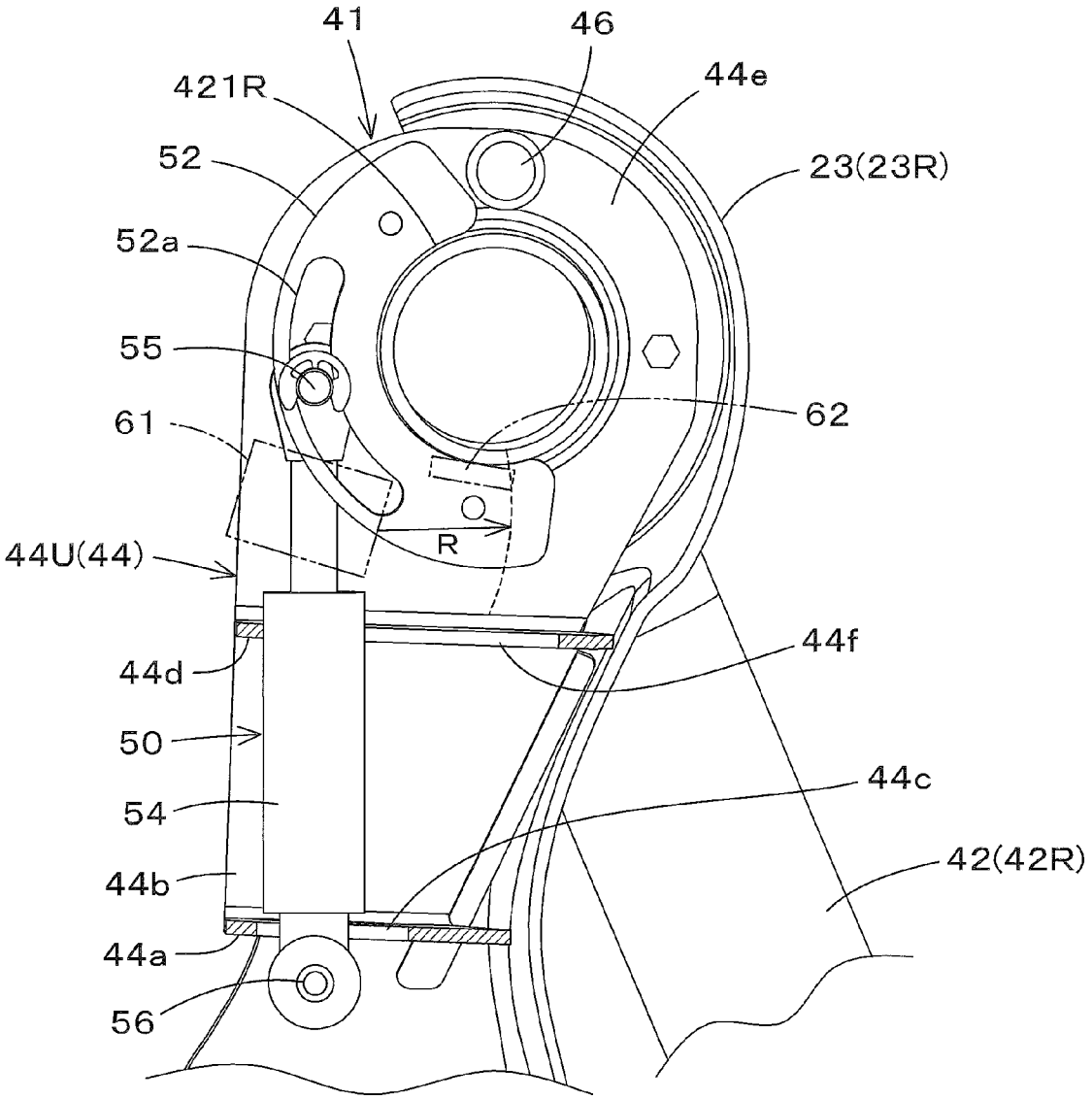
FIG. 12 is a partially cross-sectional side view showing the inner structure of the support mechanism.

As shown in FIG. 11 and FIG. 12, a shock-absorbing mechanism 50 is disposed on the supporting portion 41. The shock-absorbing mechanism 50 is a mechanism for absorbing shock generated when the operation device 30 is turned from the second position to the first position. The shock-absorbing mechanism 50 is disposed on the supporting portion 41 of the first support arm 42R, and another shock-absorbing mechanism 50 is disposed on the supporting portion 41 of the second support arm 42L. The shock-absorbing mechanism 50 disposed on the supporting portion 41 of the first support arm 42R includes configurations similar to configurations of the shock-absorbing mechanism 50 disposed on the supporting portion 41 of the second support arm 42L, and thus only the shock-absorbing mechanism 50 disposed on the first support arm 42R will be explained referring to FIG. 11 and FIG. 12.

The shock-absorbing mechanism 50 includes a movable member 51 and a damper 54. The movable member 51 is a member configured to turn in accordance with the turning of the first support arm 42R, and includes a pair of guide plates 52 and a coupling body 53. The pair of guide plates 52 are arranged between the pair of upper vertical plates 44*e* by keeping an interval in the machine width direction. Each of the guide plates 52 is formed to have an arc shape, and is fixed along an outer circumference of the first extending portion 421R of the first support arm 42R. Each of the guide plates 52 includes a rim forming an elongated hole 52*a*. The elongated hole 52*a* is formed to have an arc shape extending along an outer circumference of the first support arm 42R. The coupling body 53 is disposed between the pair of guide plates 52, and couples the pair of guide plates 52 to each other.

The damper 54 has a pushing force applied to a direction of stretching. One end portion of the damper 54 is inserted to the elongated hole 52*a* of the guide plate 52. For details, a pin 55 is attached to one end portion of the damper 54, the pin 55 is inserted to the elongated holes 52*a* of the pair of guide plates 52. The pin 55 is capable of moving along the elongated holes 52*a*. The other end of the damper 54 is fixed to a lower portion of the lower bracket 44D by an axial shaft 56. The damper 54 penetrates the upper elongated hole 44*f* and lower elongated hole 44*c* of the support bracket 44. In this manner, the damper 54 is capable of inclining forward and backward centering about the axial shaft 56 serving as a fulcrum inside the upper elongated hole 44*f* and lower elongated hole 44*c*.

The damper 54 configures a resistance providing portion, the resistance providing portion being configured to provide resistance for the turning of the operation device 30 from the second position to the first position. Meanwhile, the damper 54 is preferably employed as the resistance providing portion, and the resistance providing portion may employ other mechanisms such as a spring and a brake instead of the damper 54.

Actions of the support mechanism 40 and shock-absorbing mechanism 50 will be explained below being separated in two cases, in turning the operation device 30 downward and in turning the operation device 30 upward.

<Turning the Operation Device 30 Downward>

(The Second Position to the Third Intermediate Position)

Figure 20:
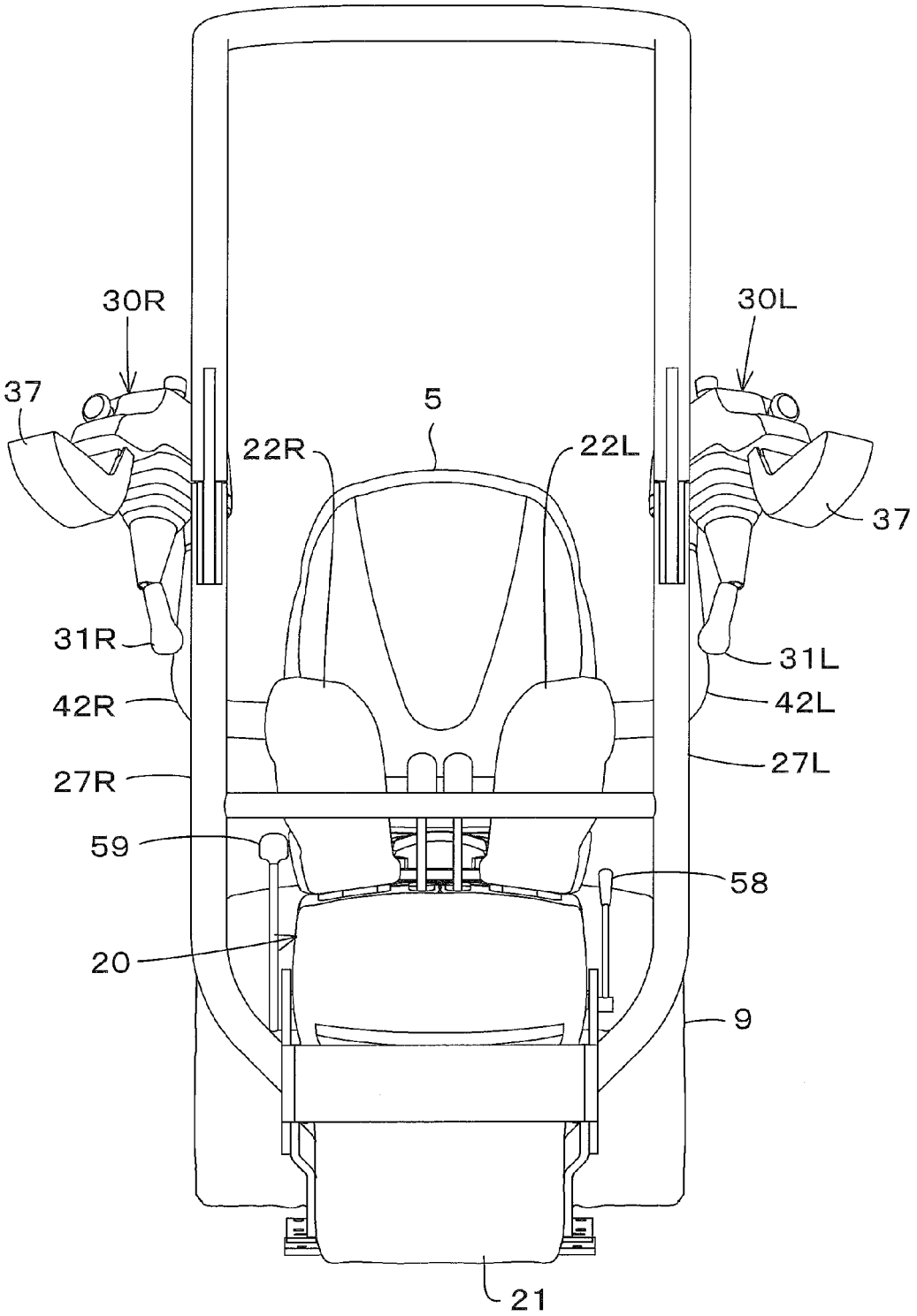
FIG. 20 is a front view showing the state of the operation device turned upward to the third intermediate position.
Figure 21:
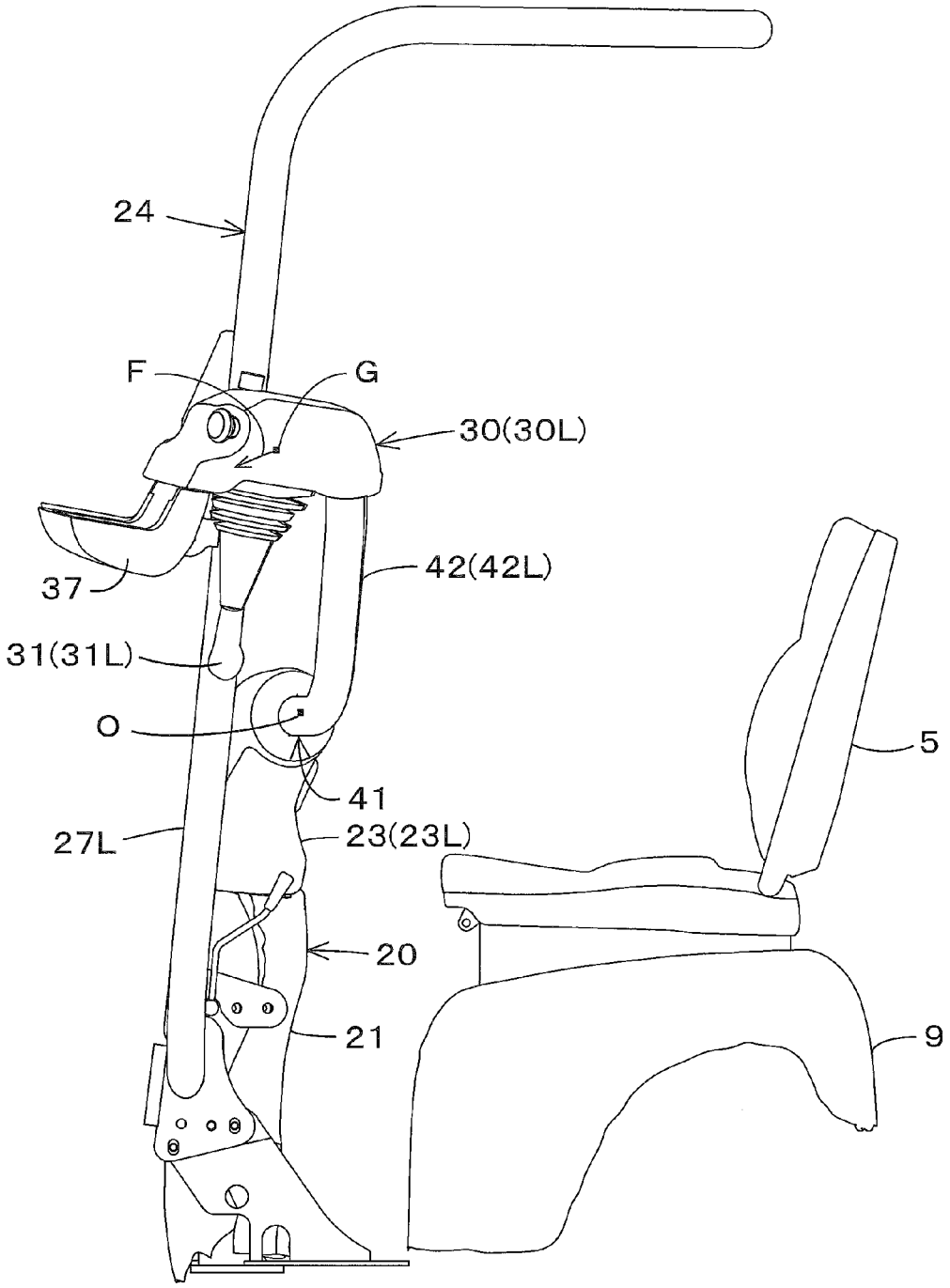
FIG. 21 is a side view showing a state of the operation device located at a second position.
Figure 22:
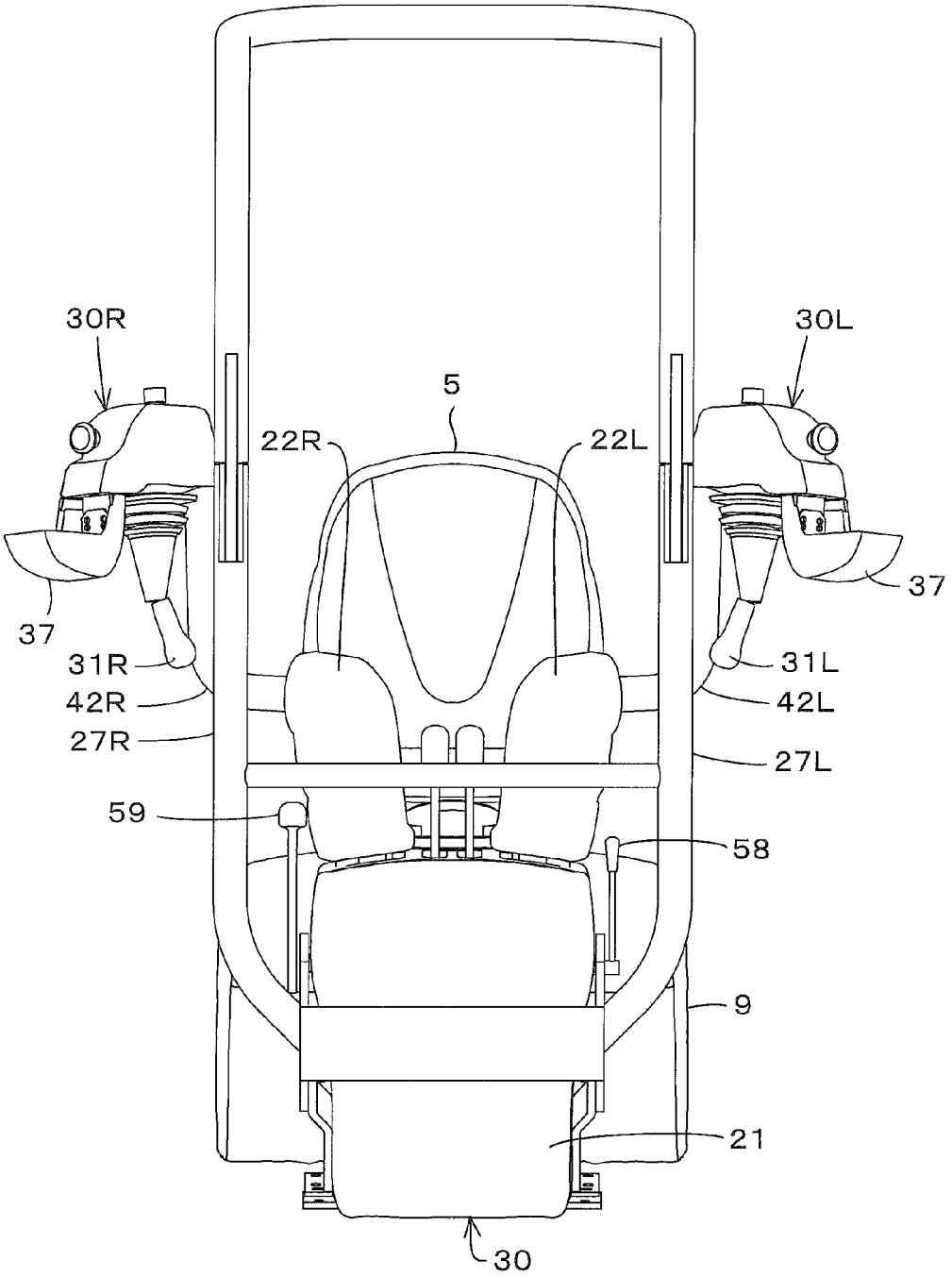
FIG. 22 is a front view showing a state of the operation device located at the second position.
Figure 23:
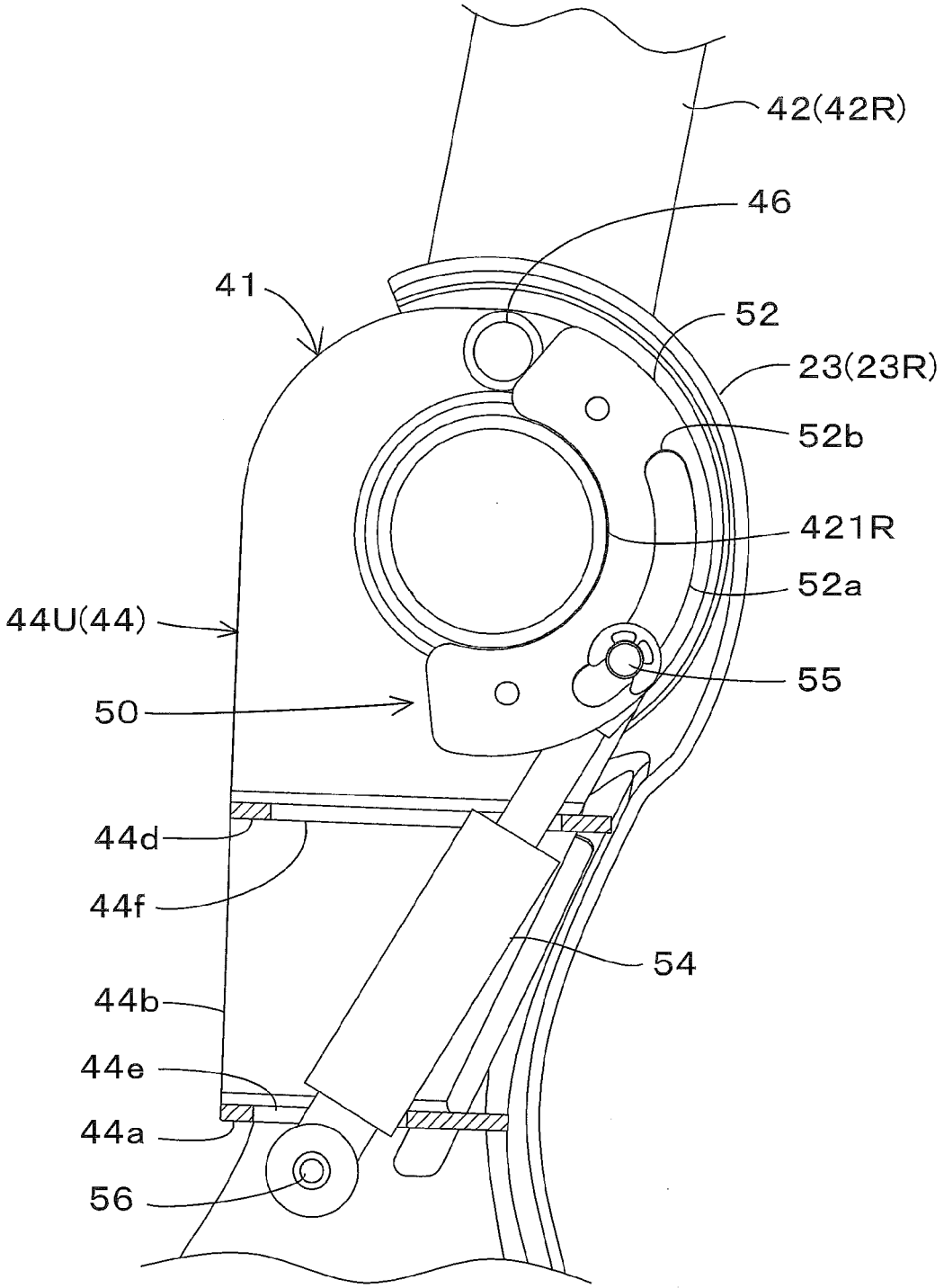
FIG. 23 is a partially cross-sectional side view of the support mechanism, the view showing the state of the operation device located at the second position.

FIG. 21 to FIG. 23 show a state where the operation device 30 is located at the second position. When the operator turns the operation device 30 downward from the second position, the support arm 42R turns downward, and the operation device 30 moves backward and downward shifting toward the machine inward direction in accordance with the turning of the support arm 42R, as shown in FIG. 19 and FIG. 20.

(The Third Intermediate Position to the Second Intermediate Position)

Figure 16:
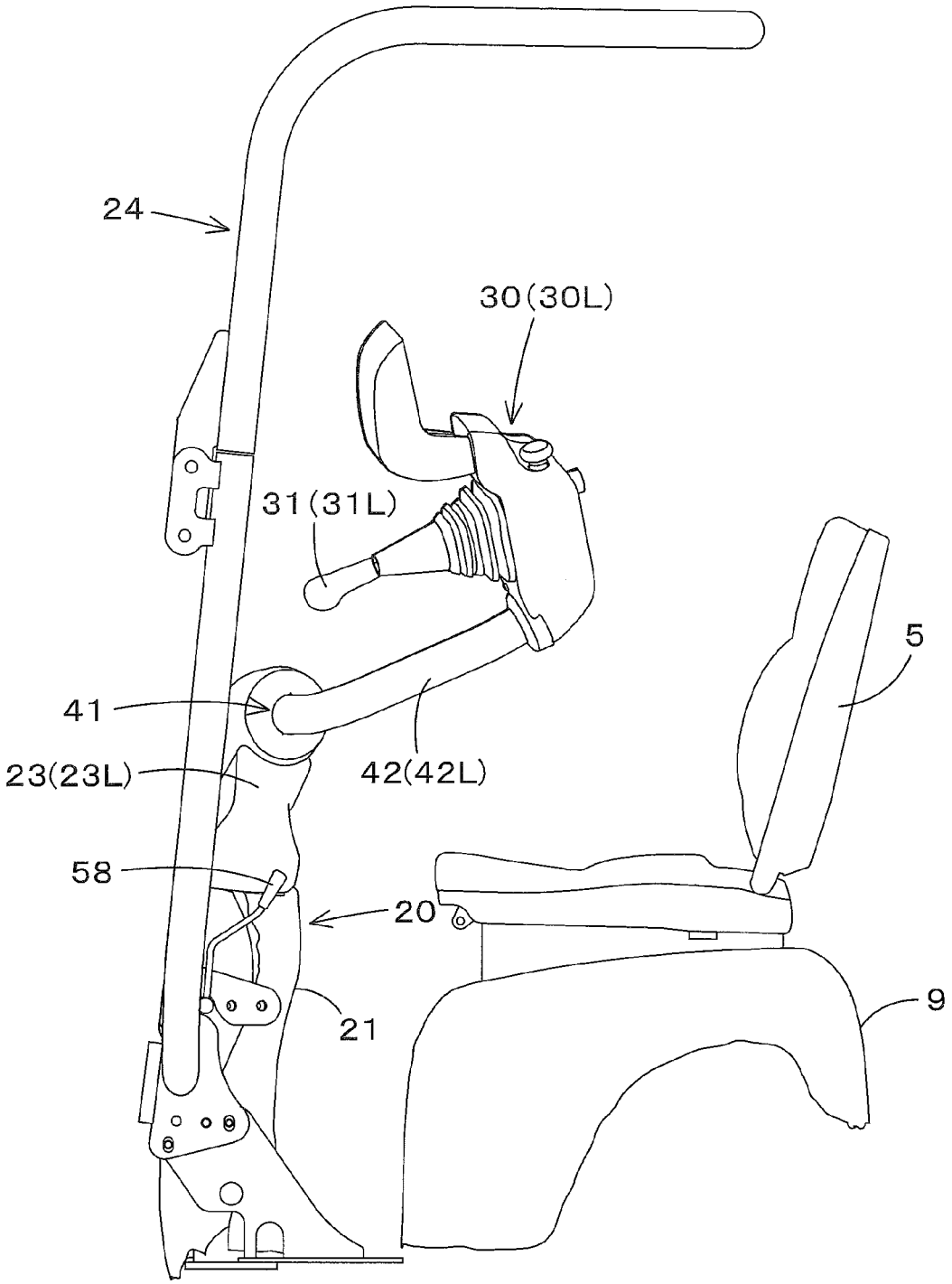
FIG. 16 is a side view showing a state of the operation device turned upward to a second intermediate position.
Figure 17:
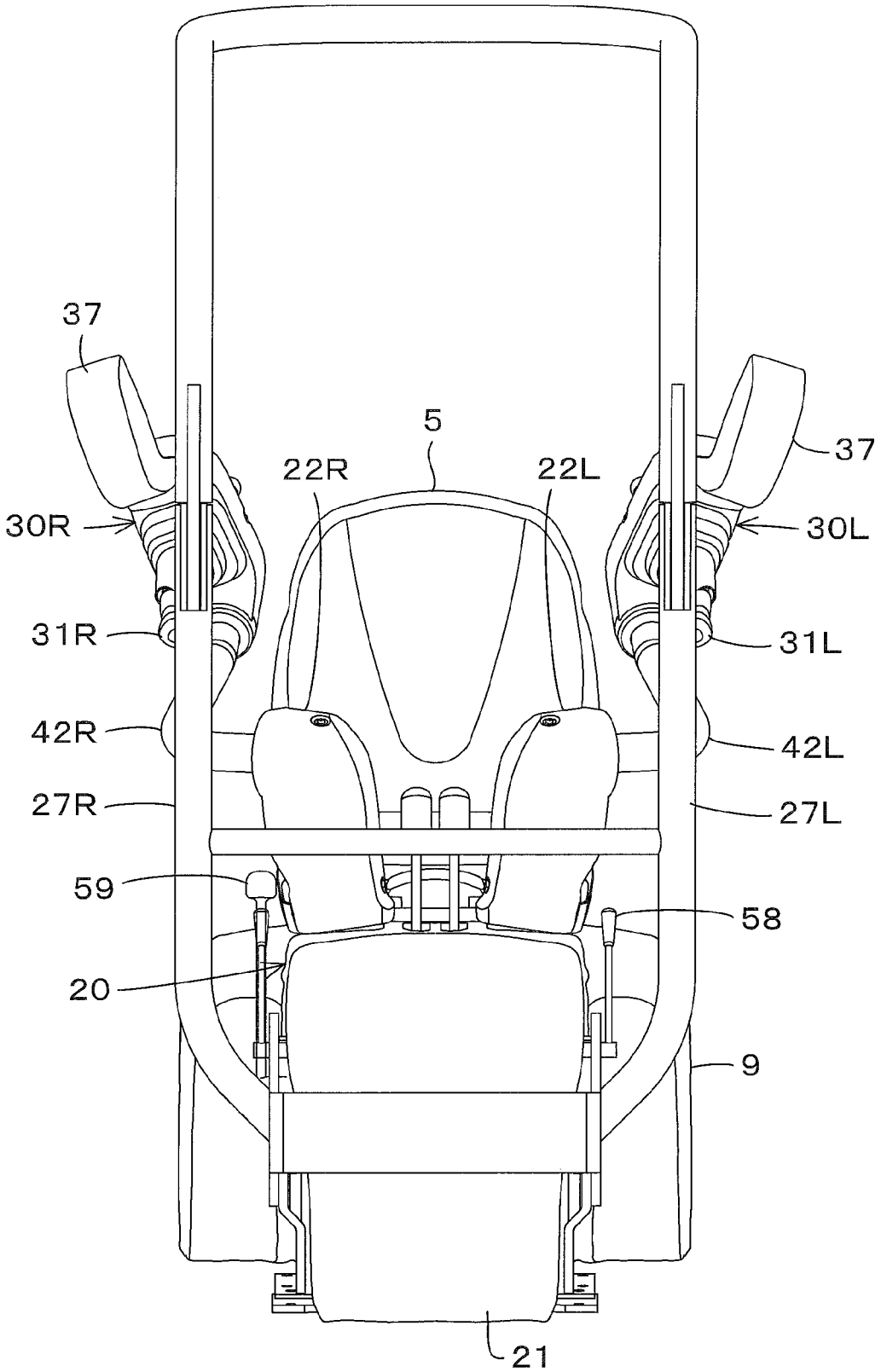
FIG. 17 is a front view showing the state of the operation device turned upward to the second intermediate position.
Figure 18:
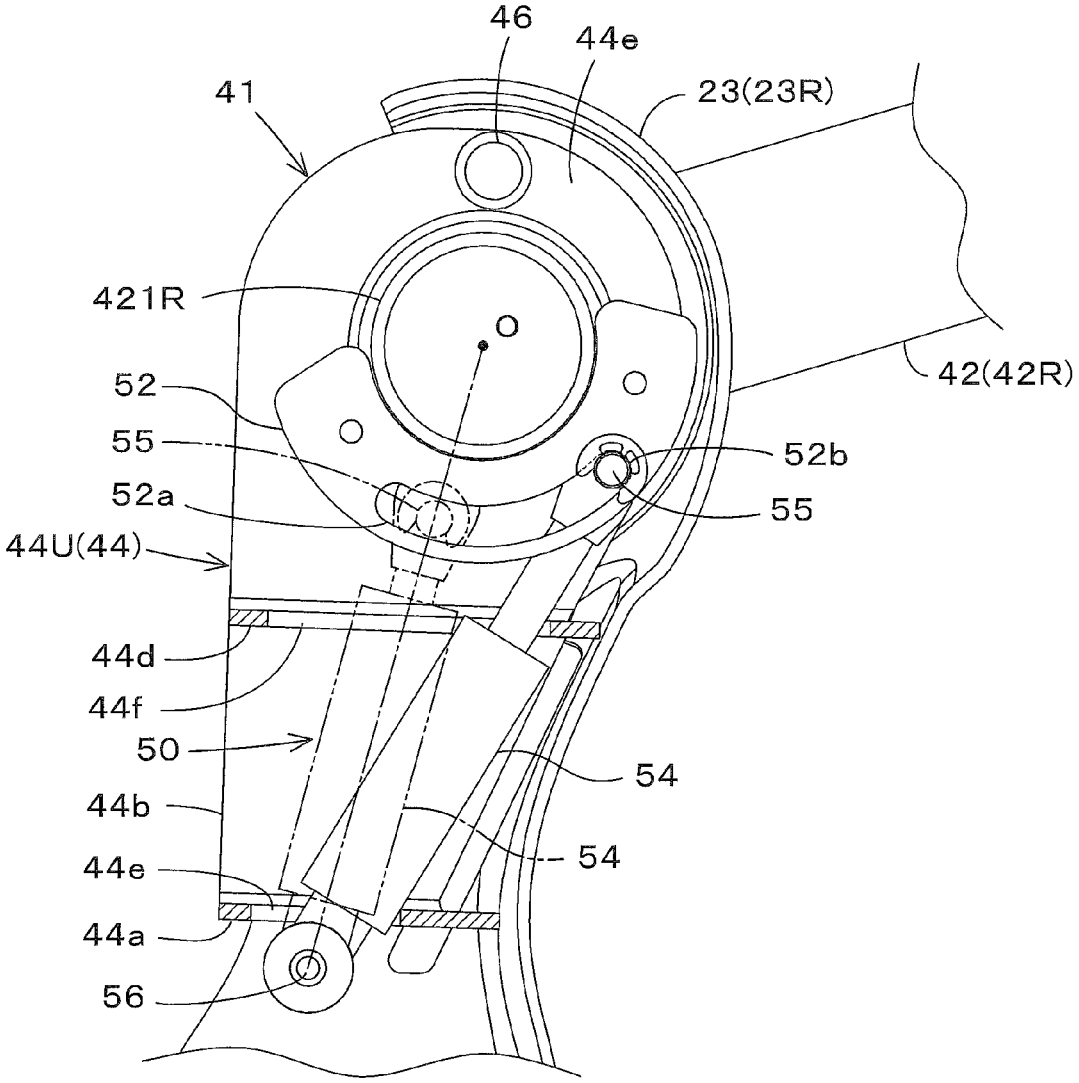
FIG. 18 is a partially cross-sectional side view of the support mechanism, the view showing the state of the operation device turned upward to the second intermediate position.
Figure 19:
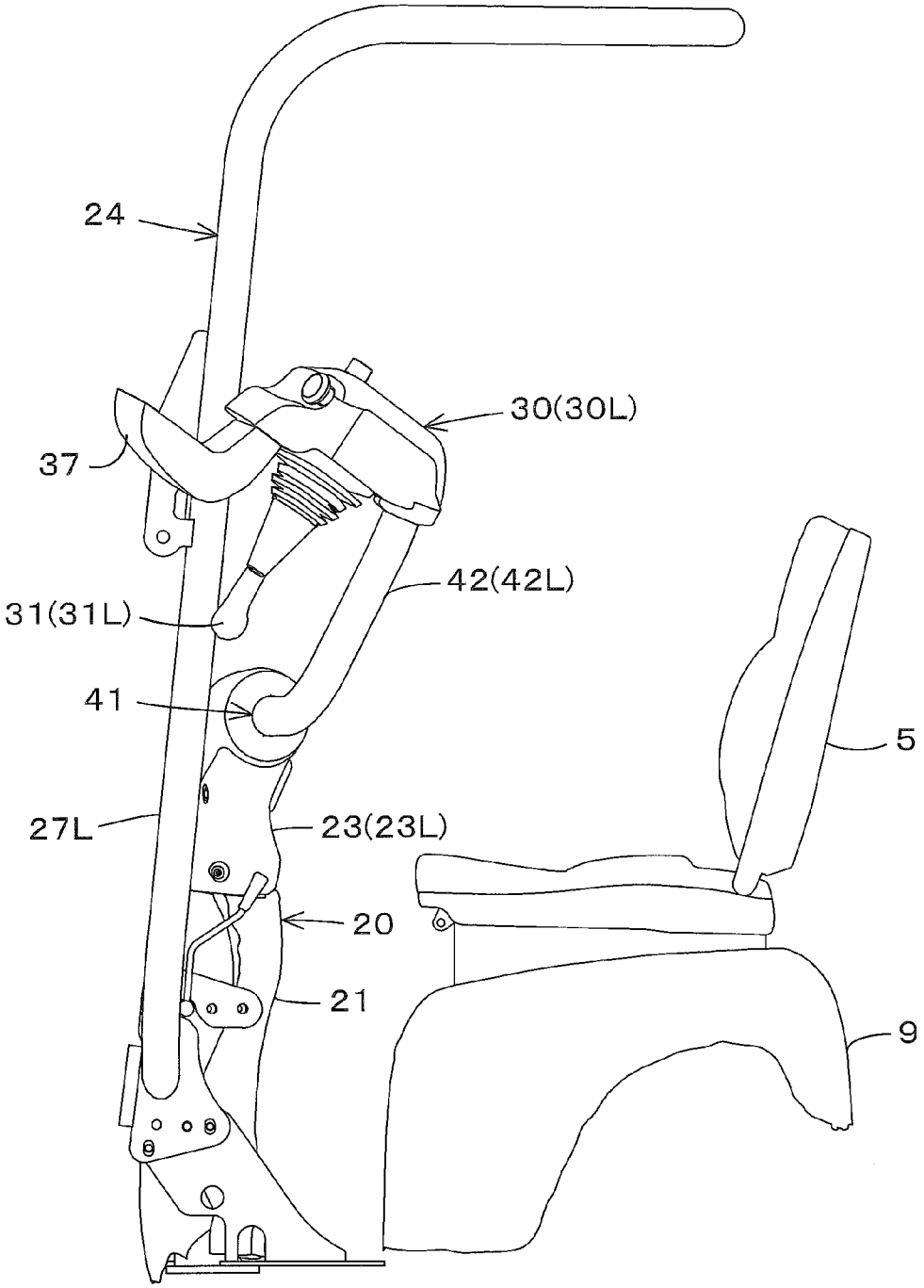
FIG. 19 is a side view showing a state of the operation device turned upward to a third intermediate position.

When the operation device 30 is continuously turned downward from the state shown in FIG. 19 and FIG. 20, the support arm 42R turns downward, and the operation device 30 moves backward and downward further shifting toward the machine inward direction, as shown in FIG. 16 and FIG. 17. In addition, as shown in FIG. 18, the guide plate 52 turns forward in accordance with the downward turning of the support arm 42R. In this manner, the elongated hole 52*a* moves relatively forward to the pin 55, and the pin 55 contacts to a rim 52*b*, the rim 52*b* being disposed on one side of the elongated hole 52*a* in the longitudinal direction.

(The Second Intermediate Position to the First Intermediate Position)

Figure 13:
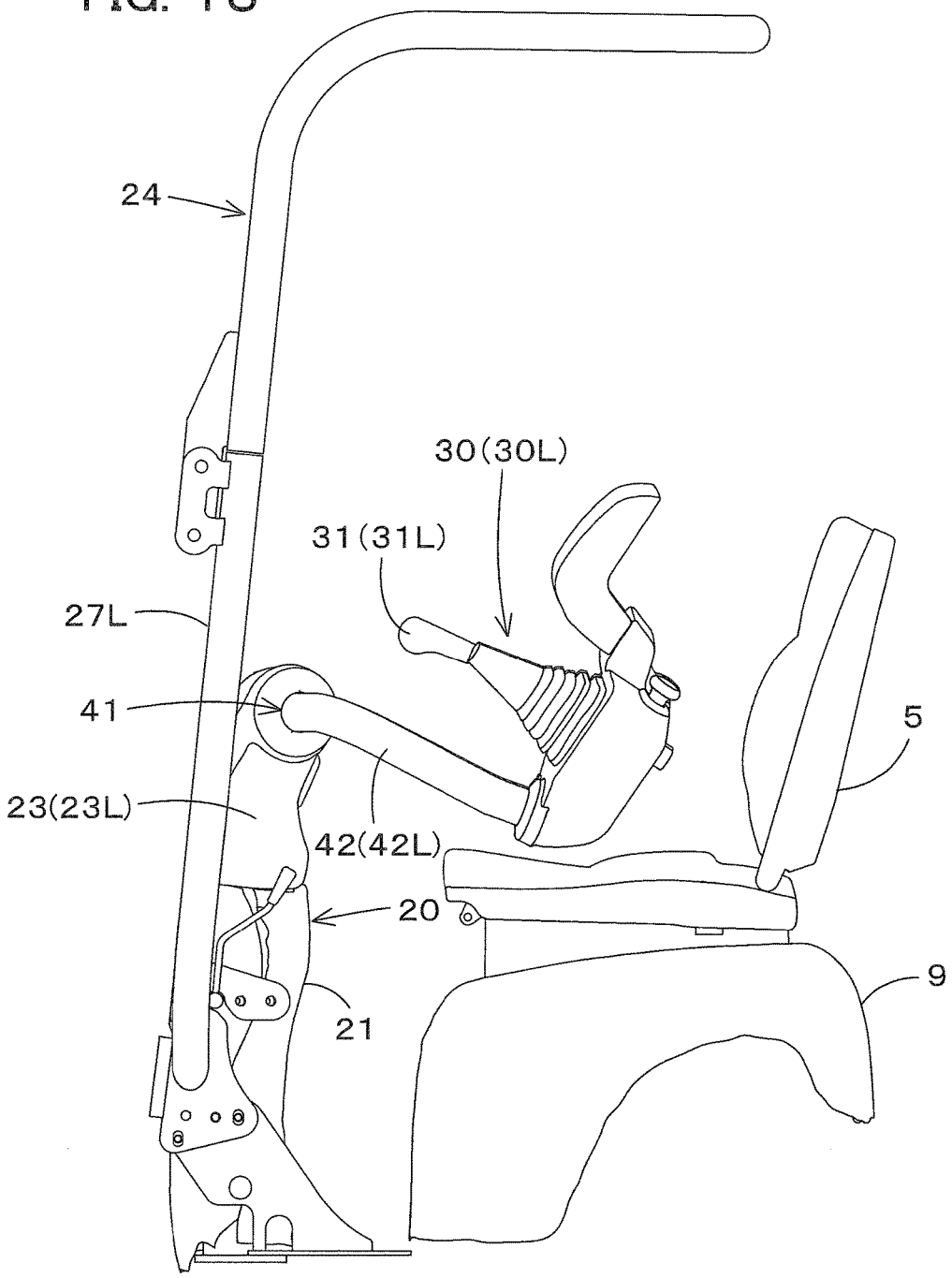
FIG. 13 is a side view showing a state of the operation device turned upward to a first intermediate position.
Figure 14:
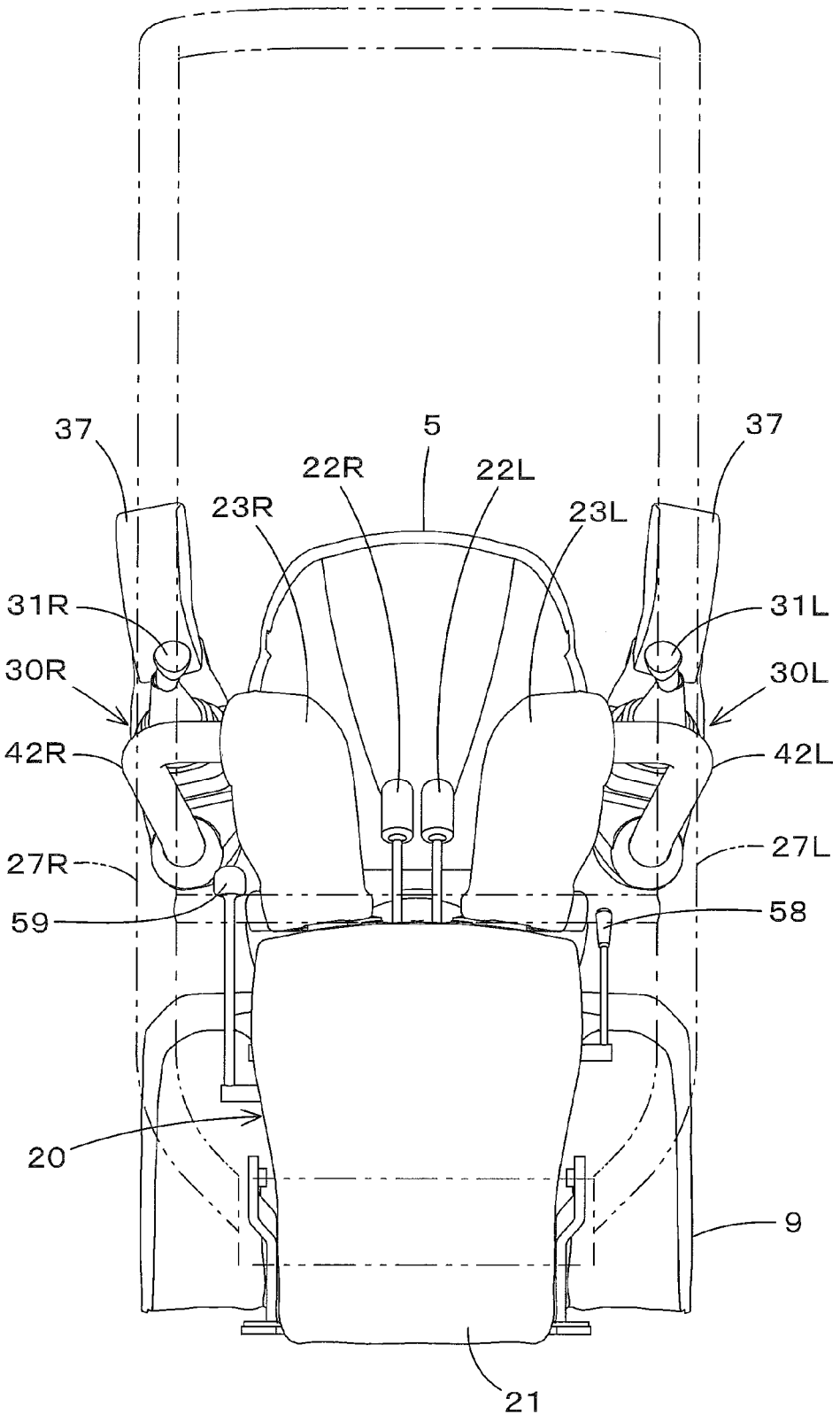
FIG. 14 is a front view showing the state of the operation device turned upward to the first intermediate position.
Figure 15:
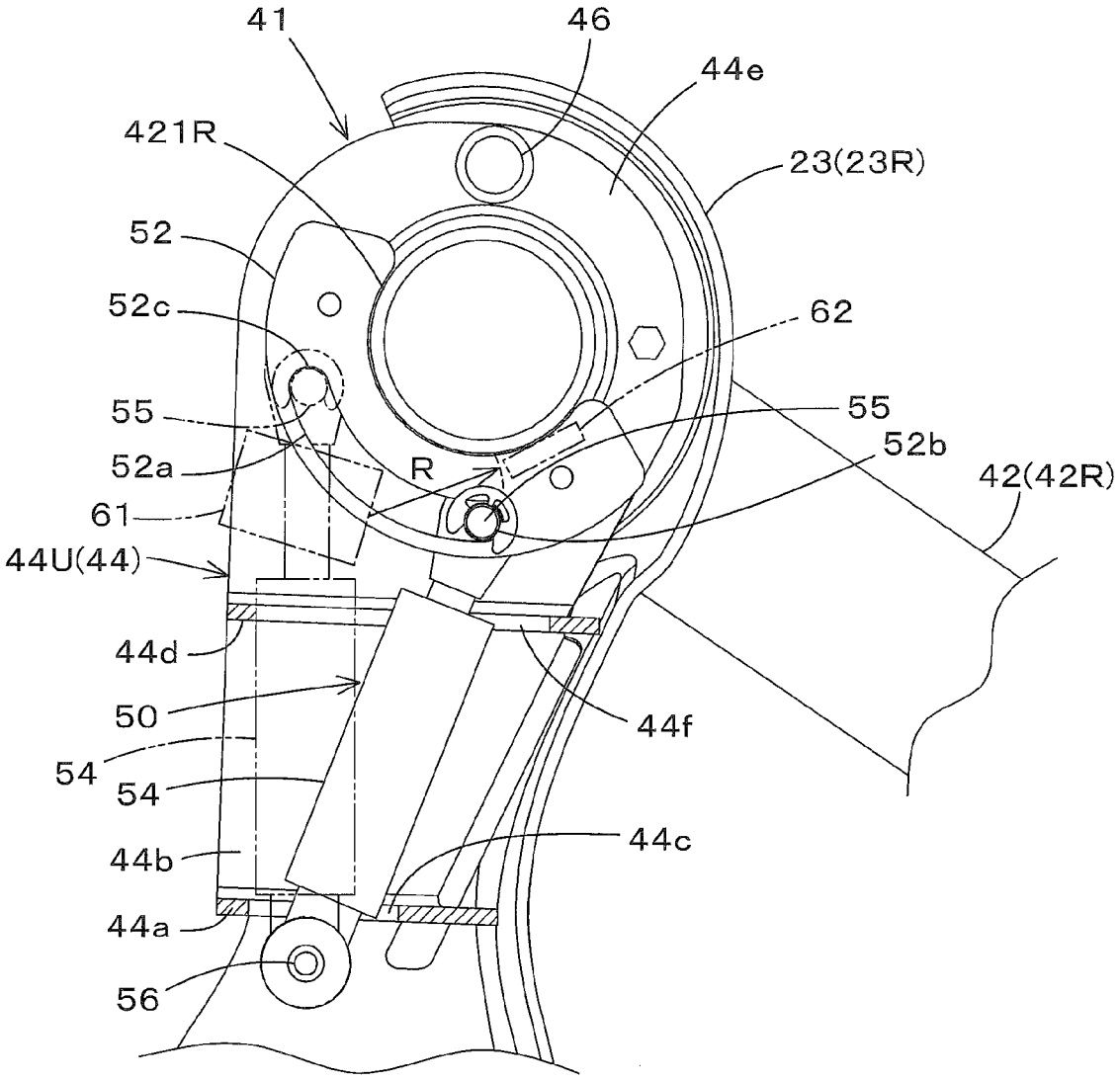
FIG. 15 is a partially cross-sectional side view of the support mechanism, the view showing the state of the operation device turned upward to the first intermediate position.

When the operation device 30 is continuously turned down from the state shown in FIG. 16 to FIG. 18, the support arm 42R turns further downward, and the operation device 30 moves backward and downward further shifting toward the machine inward direction, as shown in FIG. 13 and FIG. 14. In addition, as shown in FIG. 15, the guide plate 52 turns further forward in accordance with the downward turning of the support arm 42R. Then, the elongated hole 52*a* moves forward, and thus the pin 55 receives a pressing force from the rim 52*b*, thereby shortening the damper 54. Thus, the rim 52*b* moves against a pushing force of the damper 54 during the state from that shown in FIG. 18 to that shown in FIG. 15. In this manner, the damper 54 is shortened to provide resistance for the downward turning of the support arm 42. Thus, the downward turning of the operation device 30 is controlled, thereby preventing the operation device 30 from suddenly turning downward.

(The First Intermediate Position to the First Position)

When the operation device 30 is continuously turned down from the state shown in FIG. 13 to FIG. 15, the support arm 42R turns further downward, and the operation device 30 moves backward and downward shifting toward the machine outward direction, as shown in FIG. 2 and FIG. 4. In addition, as shown in FIG. 12, the guide plate 52 turns further forward in accordance with the downward turning of the support arm 42R. As shown in FIG. 2, the turning is stopped by the shock-absorbing member 47 hitting the upper surface of the bonnet 9. That is, the turning of the support arm 42 stops at a position (the first position) shown in FIG. 2, FIG. 4, and FIG. 12. The pin 55 is detached from the rim 52*b* in a process of changing the state from that shown in FIG. 15 to that shown in FIG. 12, and the pushing force of the damper 54 applied to the guide plates 52 is released.

As described above, the damper 54 provides resistance to the turning of the operation device 30 in a process of turning the operation device 30 from the second position to the first position, thereby preventing the operation device 30 from suddenly turning downward. That is, the shock-absorbing mechanism 50 absorbs the shock generated when the operation device 30 turns from the second position to the first position.

In addition, the damper 54 is stretched when the operation device 30 is located at the first position (refer to FIG. 12). Thus, the damper 54 does not generate the pushing force for further stretching of the damper 54 at the first position, and the pushing force of the damper 54 prevents the operation device 30 from turning upward from the first position. In addition, when the work machine 1 is vibrated in the working, the vibrations can be absorbed by the shortening of the damper 54, and thus the operation device 30 can be prevented from lifting up from the first position.

<Turning the Operation Device 30 Upward>

(The First Position (a Normal State))

The operation device 30 is located at the first position being on a side of the operator seat 5 when the operator uses the working device 4 for the working (refer to FIG. 1 to FIG. 6, and FIG. 8). At that state, the support arm 42 is located downward as shown in FIG. 12, and the guide plate 52 is located forward. In addition, the damper 54 stands upright, and the pin 55 is located on an intermediate position of the elongated hole 52*a* in the longitudinal direction.

(The First Position to the First Intermediate Position)

When the operator turns the operation device 30 upward from the first position centering about the supporting portion 41 serving as a fulcrum, the support arm 42 turns upward as shown in FIG. 13 and FIG. 14, and the operation device 30 moves forward and upward shifting toward the machine inward direction. In addition, the guide plate 52 turns backward in accordance with the upward turning of the support arm 42, and the pin 55 contacts to a rim 52*c*, the rim 52*c* being disposed on the other side of the elongated hole 52*a* in the longitudinal direction, as shown by a virtual line in FIG. 15. In this manner, the pushing force (a force to stretch) of the damper 54 is applied to the guide plate 52.

(The First Intermediate Position to the Second Intermediate Position)

When the operation device 30 is continuously turned upward from the state shown in FIG. 13, FIG. 14, and FIG. 15 (refer to the virtual line), the support arm 42R turns further upward, and the operation device 30 moves forward and upward shifting toward the machine outward direction, as shown in FIG. 16 and FIG. 17. In addition, as shown in FIG. 18, the guide plate 52 turns further backward. The pin 55 is pushed by the rim 52*c* and moves backward in accordance with the turning of the guide plate 52, and the damper 54 is inclined backward from the front centering about the axial shaft 56 serving as a fulcrum, being shortened. The pin 55 crosses over a position shown by the virtual line in FIG. 18 (a line connecting a turning fulcrum O and the axial shaft 56 to each other) and moves backward from the front, and thereby the damper 54 changes a motion thereof from the shortening to the stretching, thus helping a force to turn the support arm 42 upward, the force being provided by the operator.

(The Second Intermediate Position to the Third Intermediate Position)

When the operation device 30 is continuously turned upward from the state shown in FIG. 16 to FIG. 18, the support arm 42R turns further upward, and the operation device 30 moves forward and upward further shifting toward the machine outward direction, as shown in FIG. 19 and FIG. 20.

(The Third Intermediate Position to the Second Position)

When the operation device 30 is further turned upward from the state shown in FIG. 19 and FIG. 20, the support arm 42R turns further upward, and the operation device 30 moves forward and upward further shifting toward the machine outward direction, as shown in FIG. 21 and FIG. 22. In addition, as shown in FIG. 23, the guide plate 52 further turns backward, and the pin 55 moves backward along the elongated hole 52*a*, being stretched. Then, the guide plate 52 contacts to the restriction member 46, and thereby the turning of the guide plate 52 is blocked. In this manner, the turning of the support arm 42 stops at a position (the second position) shown in FIG. 21 to FIG. 23.

At the second position, the operation device 30 takes a posture opposite to that at the first position, that is, the posture making the operation levers 31R and 31L protrude downward and positioning the forward extending portion 39 backward. In addition, the highest portion of the operation device 30 is higher than the operator seat 5. As shown in FIG. 22, the support arm 42 is approximately parallel to the pillars 27R and 27L in a front view.

At the second position, a gravity center position G of the operation device 30 is located forward more than the turning fulcrum O as shown in FIG. 21. In this manner, a force (moment) F is continuously applied to the operation device 30, the force F for turning forward centering about the turning fulcrum O, and thereby the operation device 30 does not turn backward (downward) even when the operator takes his hands off. Thus, the operation device 30 is supported at the second position by the support mechanism 40, the second position being above and in front of the operator seat 5.

In addition, the operation device 30 moves toward the machine outward direction when turning from the position shown in FIG. 13 and FIG. 14 to the position (the second position) shown in FIG. 21 and FIG. 22. In this manner, the operation device 30 can be evacuated to a lateral side of the pillars 27R and 27L at the second position.

The switch 60 will be explained next.

The switch 60 switches turning on and off of the unload valve, thereby switching supply of the operation fluid between to be allowed to the working device 4 and not to be allowed to. As shown in FIG. 11, the switch 60 includes the sensor 61 and a detection object 62, the detection object 62 being disposed to be detected by the sensor 61. The sensor 61 is fixed to the attachment plate 44*g* of the upper bracket 44D. The sensor 61 is a non-contact sensor, and employs a magnetic sensor in the embodiment. The detection object 62 is fixed to a circumferential surface of the first extending portion 421R of the first support arm 42R, and moves in association with the turning of the first support arm 42R. The detection object 62 may be anything capable of being detected by the sensor 61, and employs a magnet in the embodiment. Meanwhile, the switch 60 having the similar configuration is disposed on the second support arm 42L, and thus explanation thereof is omitted.

The detection object 62 is in a detection range R when the first operation device 30R is located at the first position (refer to FIG. 11 and FIG. 12), the detection range R being a range where the detection object 62 is detected by the sensor 61, and the detection object 62 is out of the detection range R after staying off the first position till reaching the second position (refer to FIG. 15, FIG. 18, and FIG. 23).

The switch 60 switches the unload valve (not shown in the drawings) off when the detection object 62 is in the detection range R of the sensor 61, thereby allowing the supply of the operation fluid to the working device 4. On the other hand, the switch 60 switches the unload valve on when the detection object 62 is out of the detection range R of the sensor 61, thereby not allowing the supply of the operation fluid to the working device 4. The unload valve is arranged on an upper portion of the valve unit VU in the inner space under the operation tower cover 21.

The unload valve is switched by the switch 60 when the first support arm 42R and the second support arm 42L are turned. The following explanation describes a case of turning the first support arm 42R, similar to a case of turning the second support arm 42L.

When the first support arm 42R is turned upward to move the first operation device 30R from the first position toward the second position, the detection object 62 moves in accordance with the turning of the first support arm 42R, and is separated from the sensor 61. In this manner, as shown in FIG. 15, the detection object 62 is out of the detection range R of the sensor 61, and thereby the unload valve is switched to be turned on. On the other hand, when the first support arm 42R is turned downward to move the first operation device 30R from the second position to the first position, the detection object 62 moves in accordance with the turning of the first support arm 42R, and is close to the sensor 61. In this manner, as shown in FIG. 12, the detection object 62 is in the detection range R of the sensor 61, and thereby the unload valve is switched to be turned off.

As described above, the first support arm 42R serves as an operation member for switching supply of the hydraulic fluid between permission and prohibition due to the turning on and off of the unload valve, similar to the second arm 43L. In this manner, when the operator turns the first support arm 42R and the second support arm 42L upward, for example, in getting off the work machine 1, the unload valve is switched to be turned on in association with the upward turning, thereby disabling the working device 4 to be operated. Thus, an unload lever dedicated to switch the unload valve to be turned on can be unnecessary. In addition, it is not required to operate, as in the conventional technique, the dedicated unload lever for switching the unload valve to be turned on.

As shown in FIG. 8, the turning fulcrum O of the operation device 30 is positioned above the gravity center position G of the operation device 30 when the operation device 30 is located at the first position. Or, the turning fulcrum O is positioned above a lower end portion (an attachment portion to the casing 34) B of the operation lever 31 or above the pilot valves (the pilot valves 32R and 32L) when the operation device 30 is located at the first position. The weight of the operation device 30 and the weight of the support arm 42 generate the force to turn the operation device 30 downward accordingly. In this manner, the operation device 30 is prevented from being easily lifted up, and vibrations of the operation device 30 is suppressed, the vibrations being caused by vibrations in working and the like. That configuration improves operability, and prevents the switch 60 from being switched against the operator's will, thereby stably maintaining an unload releasing state (the state where the unload valve is turned off). In addition, the configuration can omit a configuration for fixing the operation device 30 at the first position, thereby providing a large space around legs (around knees) of the operator as shown in FIG. 8.

Moreover, as shown by a virtual line in FIG. 25, the bonnet 9 is capable of being turned backward to open an upper portion of the engine room E when the operation device 30 is turned from the first position to the second position. That configuration allows easy maintenance for equipment (for example, the engine 10) in the engine room E.

In the above description, the embodiments of the present invention has been explained. However, all the features of the embodiments disclosed in this application should be considered just as examples, and the embodiment does not restrict a scope of the present invention accordingly. A scope of the present invention is shown not in the above-described embodiments but in claims, and is intended to include all modifications within and equivalent to a scope of the claims.

In the embodiment described above, the damper 54 is, for example, stretched when the operation device 30 is located at the first position (refer to FIG. 12). However, a positional relation between the elongated hole 52*a* and the one end portion (the pin 55) of the damper 54 may be changed by changing a length of the elongated hole 52*a*, and in this manner, the damper 54 may be configured so as to be shortened when the operation device 30 is located at the first position. That case helps a force to turn the support arm 42 upward by using a pushing force to stretch the damper 54, the force being provided by the operator, thereby making the turning easy.

Further in the embodiment described above, the second position is above and in front of the operator seat 5, the second position being a position at which the support mechanism 40 supports the operation device 30. However, the second position may be behind and above the first position. In that case, a support member including the supporting portion 41 is disposed behind the operator seat 5 and above the first position, and in that configuration, the support arm 42 is turned centering about the supporting portion 41 serving as a fulcrum.

Preferable embodiments of the invention are specified in the following paragraphs:

1. A work machine includes: an operator seat; an operation device having an operation lever; a working device to be operated via the operation lever; and a support mechanism to support the operation device selectively at a first position or a second position, the first position being on a side of the operator seat, the second position being located forward with respect to the operator seat.

According to the above-mentioned configuration, a large space can be provided around legs (around knees) of the operator in comparison to a space obtained when the operation device is arranged in front of the operator seat. In addition, the work machine is configured to locate the operation device on the second position being located forward with respect to the operator seat, and thus configured to turn the bonnet backward, thereby providing an advantageous maintenance accessibility.

2. The support mechanism includes: an operation tower disposed in front of the operator seat and provided with the operation lever; and a support arm turnably supported on the operation tower at one end (a first end) and supporting the operation device at the other end (a second end) to be turned to locate the operation device on the first position and on the second position.

3. The operation tower includes a supporting portion to support the one end of the support arm turnably with respect to the operation tower, and the support arm is capable of turning about the supporting portion serving as a fulcrum.

4. The support arm locates the operation device on the second position, positioning a center of gravity of the operation device in front of the fulcrum.

5. The operation device includes a pilot valve to be operated by the operation lever, and the support arm includes an insertion path to arrange a hydraulic tube connected to the pilot valve.

6. The support arm includes: a first support arm supported turnably on one side (a first side) of the operation tower; and a second support arm supported turnably on the other side (a second side) of the operation tower, and the operation device includes: a first operation device disposed on the first support arm; and a second operation device disposed on the second support arm.

7. The first support arm includes: a first extending portion extending from the supporting portion; and a second extending portion bending at and extending from the first extending portion toward the first operation device, the second support arm includes: a first extending portion extending from the supporting portion; and a second extending portion bending at and extending from the first extending portion toward the second operation device, and the first extending portion of the first support arm and the first extending portion of the second support arm are spaced apart with a separation gradually increasing from the supporting portion.

8. The work machine includes a pillar disposed standing in front of the operator seat, wherein the support arm locates the operation device on a side of the pillar at the second position.

9. The working device includes a hydraulic actuator to be operated by an operation fluid, and the support arm is an operation member to switch supply of the hydraulic fluid between permission and prohibition, the support arm permitting the supply of the hydraulic fluid when the operation device is located on the first position and prohibiting the supply of the hydraulic fluid when the operation device is located on the second position.

10. A support mechanism for an operation device includes a support arm to support an operation device selectively at a first position or a second position, the first position being on a side of the operator seat, the second position being located forward with respect to the operator seat.

According to the above-mentioned configuration, a large space can be provided around legs (around knees) of the operator in comparison to a space obtained when the operation device is arranged in front of the operator seat. In addition, the work machine is configured to locate the operation device on the second position being located forward with respect to the operator seat, and thus configured to turn the bonnet backward, thereby providing an advantageous maintenance accessibility.

11. The support aim is turnably supported on a support member at one end (a first end), the support member being disposed in front of the operator seat, and supports the operation device at the other end (a second end) to be turned to locate the operation device on the first position and on the second position.

12. A work machine includes: an operator seat; an operation device to be turned around a fulcrum between a first position being on a side of the operator seat and a second position being located upward with respect to the first position, the fulcrum being positioned above a center of gravity of the operation device when the operation device is located on the first position, the operation device having an operation lever; and a working device to be operated via the operation lever.

According to the above-mentioned configuration, the fulcrum of the turning is positioned above a center of gravity of the operation device when the operation device is located on the first position, and thereby the operation device turns downward centered about the fulcrum due to the operation device's own weight. In this manner, the configuration makes the operation device hard to be lifted up from the first position, thereby suppressing vibrations of the operation device, the vibrations being caused by vibrations in working and the like.

13. The operation device includes: a pilot valve disposed under the operation lever and connected to the operation lever; and a casing to house the pilot valve, the casing including: an anterior extending portion extending anterior to the operation lever, and a side portion of the anterior extending portion is extended in a diagonal direction with a separation gradually increasing forward from the operator seat, the side portion being on a side of the operator seat.

14. The work machine includes: a machine body including the operator seat; an operation tower disposed in front of the operator seat and having the operation lever; a support arm turnably supported on the operation tower at one end (a first end) and supporting the operation device at the other end (a second end) to be turned to locate the operation device on the first position and on the second position; a supporting portion to support the one end of the support arm turnably with respect to the operation tower; and a supporting portion cover to cover the supporting portion, wherein a surface of the supporting portion cover is inclined downwardly toward a center of a machine width direction, the surface being an outside of the supporting portion cover in the machine width direction.

15. A support mechanism for an operation device includes a supporting portion to support the operation device to be turned around a fulcrum between a first position being on a side of the operator seat and a second position being located upward with respect to the first position, the fulcrum being positioned above a center of gravity of the operation device when the operation device is located on the first position.

According to the above-mentioned configuration, the fulcrum of the turning is positioned above a center of gravity of the operation device when the operation device is located on the first position, and thereby the operation device turns downward centered about the fulcrum due to the operation device's own weight. In this manner, the configuration makes the operation device hard to be lifted up from the first position, thereby suppressing vibrations of the operation device, the vibrations being caused by vibrations in working and the like.

16. A work machine includes: an operator seat; an operation device having an operation lever; a working device to be operated via the operation lever; and a support mechanism to support the operation device to be turned between a first position being on a side of the operator seat and a second position being located forward with respect to the first position; and a shock-absorbing mechanism to absorb a shock generated when the operation device is turned from the second position to the first position.

According to the above-mentioned configuration, the shock-absorbing mechanism is capable of absorbing a shock generated when the operation device is moved downward from the second position to the first position.

17. The support mechanism includes: a support member disposed around the operator seat; and a support arm turnably supported on the support member at one end (a first end) and supporting the operation device at the other end (a second end) to be turned to locate the operation device on the first position and on the second position, and the shock-absorbing mechanism is disposed on a supporting portion to support the one end of the support arm turnably with respect to the support member.

18. The shock-absorbing mechanism includes: a movable member to turn with the turning of the support arm; and a damper disposed on the movable member at one end portion of the damper and fixed to the support member at the other end portion of the damper, the damper providing resistance to the turning from the second position to the first position.

19. The movable member includes a guide plate having a looped rim that forms an elongated hole extending along an outer circumference of the support arm, and the one end portion of the damper is inserted to the elongated hole of the guide plate.

20. The one end portion of the damper is contacted to the looped rim and given a pressing force when the movable member is turned with movement of the operation device from the second position to the first position.

21. The work machine includes a switch to switch supply of a hydraulic fluid to the working device between permission and prohibition, the switch including: a sensor; and a detection object to be detected by the sensor and to move with the turning of the support arm, wherein when the operation device is located on the first position, the detection object is positioned in a detection range where the detection object is detected by the sensor, and the detection object is positioned out of the detection range when the operation device is located on the second position, and the switch permits the supply of the hydraulic fluid when the detection object is positioned in the detection range and prohibits the supply of the hydraulic fluid when the operation device is positioned out of the detection range.

22. A shock-absorbing mechanism for an operation device includes a resistance providing portion to provide resistance for a turning of the operation device to a first position being on a side of an operator seat from a second position being located upward with respect to the first position. The operation device has an operation lever.

According to the above-mentioned configuration, the resistance provided by the resistance providing portion suppresses a speed of the downward movement of the operation device, thereby absorbing the shock generated when the operation device is moved downward from the second position to the first position.

23. The shock-absorbing mechanism for the operation device includes a movable member to turn with the turning of the operation device, wherein the resistance providing portion includes a damper, the damper being disposed on the movable member at one end portion of the damper and fixed to a support member at the other end portion of the damper, the support member being disposed around the operator seat.

Obviously, numerous modifications and variations of the present invention are possible in light of the above teachings. It is therefore to be understood that within the scope of the appended claims, the invention may be practiced otherwise than as specifically described herein.

What is claimed is:

1. A work machine comprising:
an operator seat;
an operation device having an operation lever;
a working device to be operated via the operation lever;
a support mechanism to support the operation device selectively at a first position or a second position, the first position being on a side of the operator seat, the second position being located forward with respect to the operator seat, the support mechanism comprising:
an operation tower disposed in front of the operator seat and provided with the operation lever; and
a support arm turnably supported on the operation tower at one end and supporting the operation device at the other end to be turned to locate the operation device on the first position and on the second position, the support arm comprising:
a first support arm supported turnably on one side of the operation tower; and
a second support arm supported turnably on the other side of the operation tower; and
the operation device comprising:
a first operation device disposed on the first support arm; and
a second operation device disposed on the second support arm.

2. The work machine according to claim 1, wherein
the operation tower includes
a supporting portion to support the one end of the support arm turnably with respect to the operation tower, and
the support arm is capable of turning about the supporting portion serving as a fulcrum.

3. The work machine according to claim 1, wherein
the support arm locates the operation device on the second position, positioning a center of gravity of the operation device in front of the fulcrum.

4. The work machine according to claim 1, wherein
the operation device includes
a pilot valve to be operated by the operation lever, and
the support arm includes
an insertion path to arrange a hydraulic tube connected to the pilot valve.

5. The work machine according to claim 1, wherein
the first support arm includes:
a first extending portion extending from the supporting portion; and
a second extending portion bending at and extending from the first extending portion toward the first operation device,
the second support arm includes:
a first extending portion extending from the supporting portion; and
a second extending portion bending at and extending from the first extending portion toward the second operation device, and
the first extending portion of the first support arm and the first extending portion of the second support arm are spaced apart with separation gradually increasing from the supporting portion.

6. The work machine according to claim 1, comprising
a pillar disposed standing in front of the operator seat, wherein
the support arm locates the operation device on a side of the pillar at the second position.

7. The work machine according to claim 1, wherein
the working device includes
a hydraulic actuator to be operated by an operation fluid, and
the support arm is an operation member to switch supply of the hydraulic fluid between permission and prohibition, the support arm permitting the supply of the hydraulic fluid when the operation device is located on the first position and prohibiting the supply of the hydraulic fluid when the operation device is located on the second position.

8. A work machine comprising:
an operator seat;
an operation device to be turned around a fulcrum between a first position being on a side of the operator seat and a second position being located upward with respect to the first position, the fulcrum being positioned above a center of gravity of the operation device when the operation device is located on the first position, the operation device having an operation lever; and
a working device to be operated via the operation lever.

9. The work machine according to claim 8, wherein
the operation device includes:
a pilot valve disposed under the operation lever and connected to the operation lever; and
a casing to house the pilot valve, the casing including:
an anterior extending portion extending anterior to the operation lever, and
a side portion of the anterior extending portion is extended in a diagonal direction with a separation gradually increasing forward from the operator seat, the side portion being on a side of the operator seat.

10. The work machine according to claim 8, comprising:
a machine body including the operator seat;
an operation tower disposed in front of the operator seat and having the operation lever;
a support arm turnably supported on the operation tower at one end and supporting the operation device at the other end to be turned to locate the operation device on the first position and on the second position;
a supporting portion to support the one end of the support arm turnably with respect to the operation tower; and
a supporting portion cover to cover the supporting portion, wherein
a surface of the supporting portion cover is inclined downwardly toward a center of a machine width direction, the surface being an outside of the supporting portion cover in the machine width direction.

11. A support mechanism for an operation device, comprising
a supporting portion to support the operation device to be turned around a fulcrum between a first position being on a side of the operator seat and a second position being located upward with respect to the first position, the fulcrum being positioned above a center of gravity of the operation device when the operation device is located on the first position.

12. A work machine comprising:
an operator seat;
an operation device having an operation lever;
a working device to be operated via the operation lever; and
a support mechanism to support the operation device to be turned between a first position being on a side of the operator seat and a second position being located upward with respect to the first position; and a shock-absorbing mechanism to absorb a shock generated when the operation device is turned from the second position to the first position.

13. The work machine according to claim 12, wherein the support mechanism includes:

a support member disposed around the operator seat; and a support arm turnably supported on the support member at one end and supporting the operation device at the other end to be turned to locate the operation device on the first position and on the second position, and the shock-absorbing mechanism is disposed on a supporting portion to support the one end of the support arm turnably with respect to the support member.

14. The work machine according to claim 13, wherein the shock-absorbing mechanism includes:

a movable member to turn with the turning of the support arm; and a damper disposed on the movable member at one end portion of the damper and fixed to the support member at the other end portion of the damper, the damper providing resistance to the turning from the second position to the first position.

15. The work machine according to claim 14, wherein the movable member includes a guide plate having a looped rim that forms an elongated hole extending along an outer circumference of the support arm, and the one end portion of the damper is inserted to the elongated hole of the guide plate.

16. The work machine according to claim 15, wherein the one end portion of the damper is contacted to the looped rim and given a pressing force when the movable member is turned with movement of the operation device from the second position to the first position.

17. The work machine according to claim 13, comprising a switch to switch supply of a hydraulic fluid to the working device between permission and prohibition, the switch including:

a sensor; and a detection object to be detected by the sensor and to move with the turning of the support arm, wherein when the operation device is located on the first position, the detection object is positioned in a detection range where the detection object is detected by the sensor, and the detection object is positioned out of the detection range when the operation device is located on the second position, and the switch permits the supply of the hydraulic fluid when the detection object is positioned in the detection range and prohibits the supply of the hydraulic fluid when the operation device is positioned out of the detection range.

* * * * *